US006305281B1

(12) United States Patent
Aizawa

(10) Patent No.: US 6,305,281 B1
(45) Date of Patent: Oct. 23, 2001

(54) STENCIL PRINTER HAVING CONTROLLER FOR DISCHARGE TRAY AND MASTER MAKING MEANS

(75) Inventor: Hidetoshi Aizawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/401,840

(22) Filed: Sep. 22, 1999

(30) Foreign Application Priority Data

Oct. 27, 1998 (JP) ..... 10-305462

(51) Int. Cl.[7] ..... B41L 13/04

(52) U.S. Cl. ..... 101/118; 101/116; 271/3.15; 271/298; 271/223

(58) Field of Search ..... 101/116, 117, 101/118, 119, 120, 129, 483, 484, 485, DIG. 36; 271/3.15, 9.06, 223, 298, 296; 399/370, 16, 86, 389, 405, 403; 358/449, 451, 452

(56) References Cited

U.S. PATENT DOCUMENTS 5,349,422 * 9/1994 Ohashi ..... 355/243
5,507,225 * 4/1996 Noguchi et al. ..... 101/116

FOREIGN PATENT DOCUMENTS 64-18683 1/1989 (JP) .
64-24783 1/1989 (JP) .
5-306025 11/1993 (JP) .
10-1254 1/1998 (JP) .
10-193767 7/1998 (JP) .

* cited by examiner

*Primary Examiner*—John S. Hilten
*Assistant Examiner*—Leslie J. Grohusky
(74) *Attorney, Agent, or Firm*—Oblon, Spivak, McClelland, Maier & Neustadt, P.C.

(57) ABSTRACT

A stencil printer includes a document size sensing device for sensing the size of a document and a paper size sensing device for sensing the size of papers. A controller determines the orientation and size of the document and those of the paper on the basis of information output from the two sensing devices. If the document and paper are different in orientation, the controller controls a master making section on the basis of the orientation of the papers for forming a document image in a master in accordance with the orientation of the paper. At the same time, the controller controls a side fence moving device and an end fence moving device such that side fences and an end fence mounted on a paper discharge tray each are located at a particular position matching with the size of the papers. The side fences are movable in the widthwise direction of the paper while the end fence is movable forward and backward in the direction of paper discharge.

29 Claims, 26 Drawing Sheets

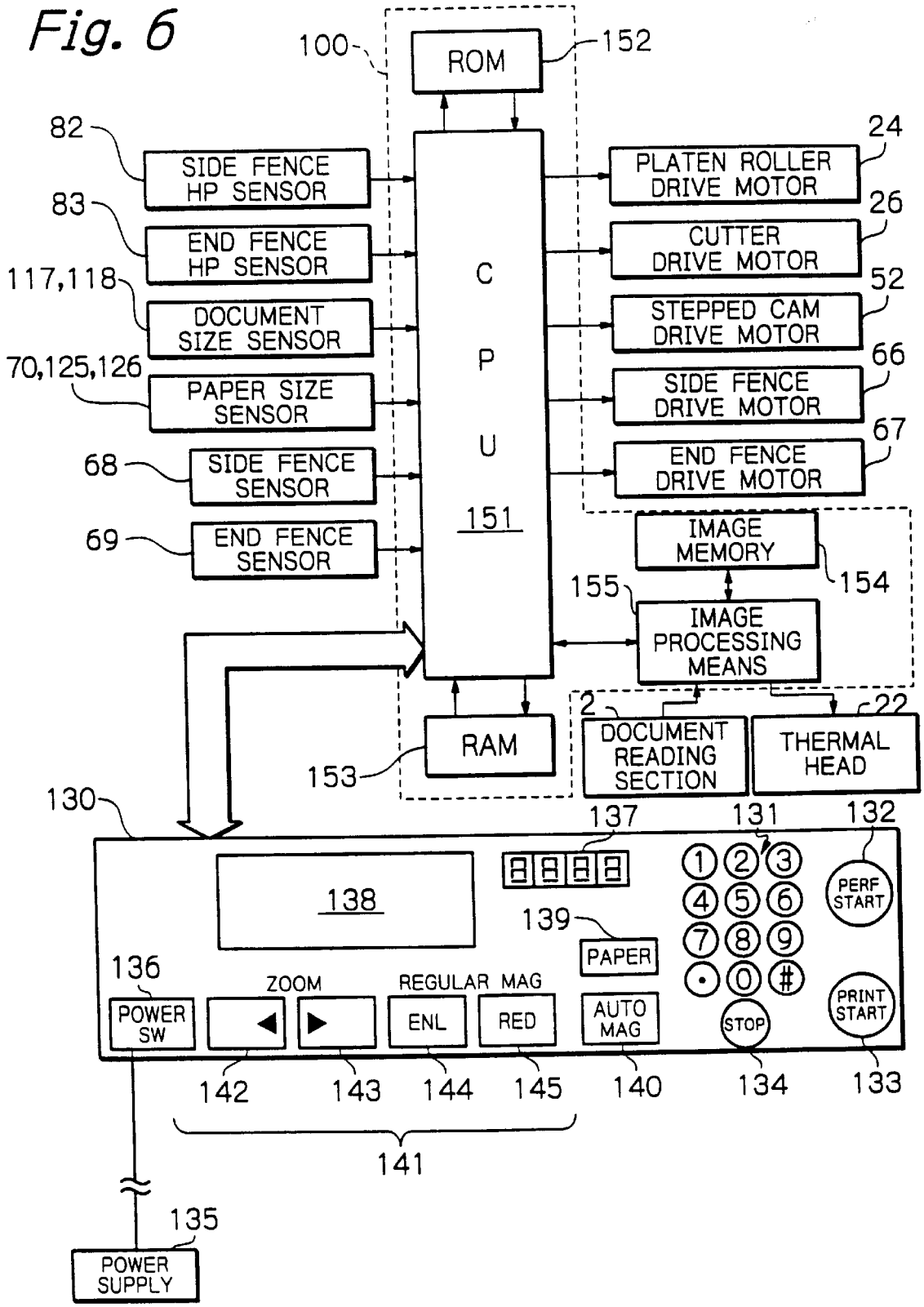
Fig. 6
100
ROM
152
82
SIDE FENCE HP SENSOR
83
END FENCE HP SENSOR
117,118
DOCUMENT SIZE SENSOR
70,125,126
PAPER SIZE SENSOR
68
SIDE FENCE SENSOR
69
END FENCE SENSOR
C P U
151
PLATEN ROLLER DRIVE MOTOR
24
CUTTER DRIVE MOTOR
26
STEPPED CAM DRIVE MOTOR
52
SIDE FENCE DRIVE MOTOR
66
END FENCE DRIVE MOTOR
67
IMAGE MEMORY
154
155
IMAGE PROCESSING MEANS
2
DOCUMENT READING SECTION
22
THERMAL HEAD
RAM
153
130
137
131
132
138
139
PAPER
136
POWER SW
ZOOM
REGULAR MAG
ENL
RED
AUTO MAG
PERF START
PRINT START
STOP
142
143
144
145
140
134
133
141
135
POWER SUPPLY

| FIG. 8A |
| --- |
| FIG. 8B |

| FIG. 9A |
| --- |
| FIG. 9B |

| FIG. 10A |
| --- |
| FIG. 10B |

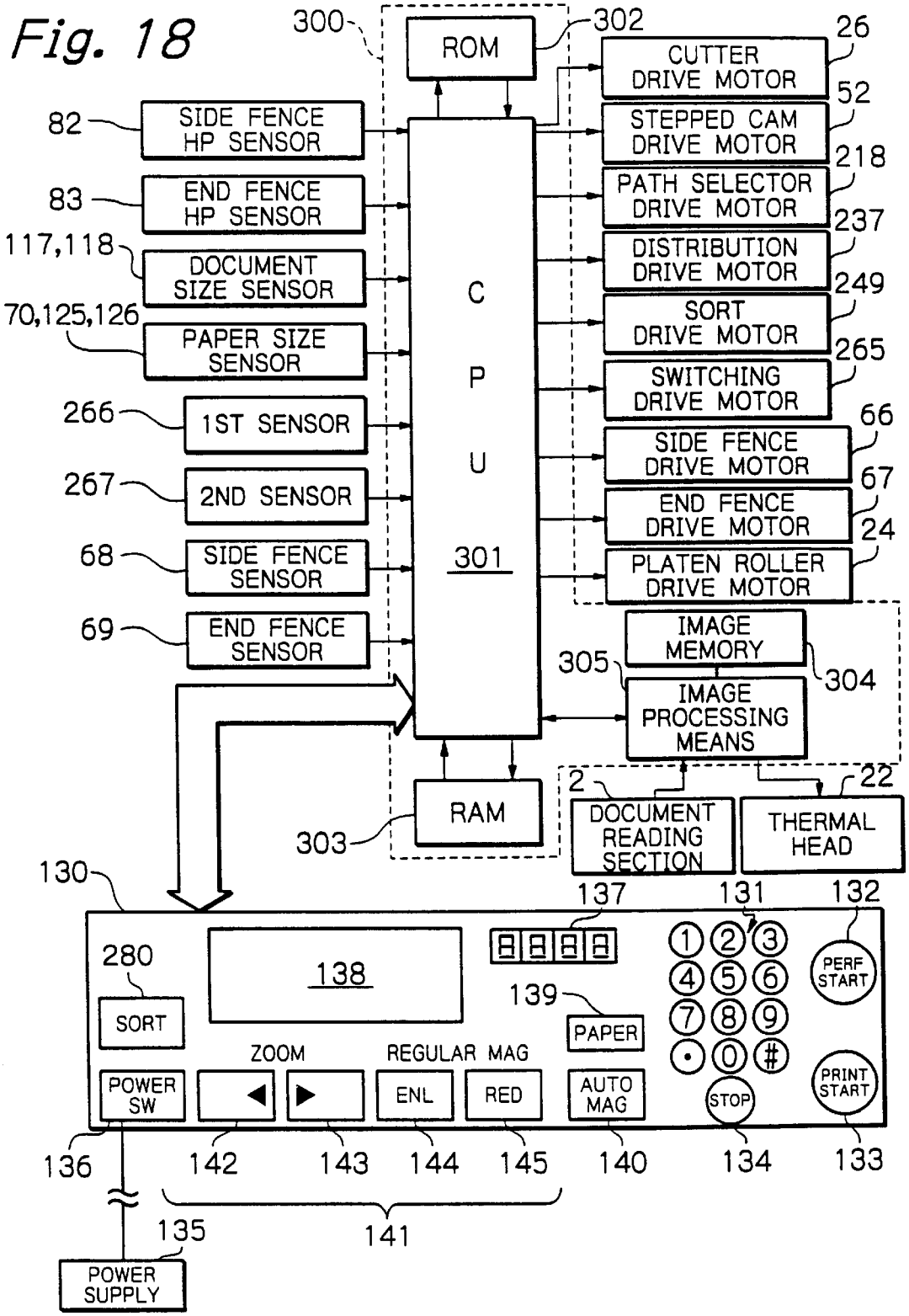
Fig. 18
300
ROM
302
CUTTER DRIVE MOTOR
26
STEPPED CAM DRIVE MOTOR
52
PATH SELECTOR DRIVE MOTOR
218
DISTRIBUTION DRIVE MOTOR
237
SORT DRIVE MOTOR
249
SWITCHING DRIVE MOTOR
265
SIDE FENCE DRIVE MOTOR
66
END FENCE DRIVE MOTOR
67
PLATEN ROLLER DRIVE MOTOR
24
82
SIDE FENCE HP SENSOR
83
END FENCE HP SENSOR
117,118
DOCUMENT SIZE SENSOR
70,125,126
PAPER SIZE SENSOR
266
1ST SENSOR
267
2ND SENSOR
68
SIDE FENCE SENSOR
69
END FENCE SENSOR
CPU
301
IMAGE MEMORY
305
304
IMAGE PROCESSING MEANS
2
22
DOCUMENT READING SECTION
THERMAL HEAD
RAM
303
130
137
131
132
280
138
139
SORT
PAPER
PERF START
ZOOM
REGULAR MAG
POWER SW
ENL
RED
AUTO MAG
STOP
PRINT START
136
142
143
144
145
140
134
133
135
141
POWER SUPPLY

| FIG. 19A-1 |
| --- |
| FIG. 19A-2 |

Fig. 20

★ ROTATION

| PAPER \ DOCUMENT | A3 HOR | B4 HOR | A4 HOR | A4 VER | B5 HOR | B5 VER | A5 HOR | A5 VER |
|---|---|---|---|---|---|---|---|---|
| A3 HOR | 100% | 115% | 141% | 141%★ | 163% | 163%★ | 200% | 200%★ |
| B4 HOR | 87% | 100% | 122% | 122%★ | 141% | 141%★ | 173% | 173%★ |
| A4 HOR | 71% | 82% | 100% | 100%★ | 115% | 115%★ | 141% | 141%★ |
| A4 VER | 71%★ | 82%★ | 100%★ | 100% | 115%★ | 115% | 141%★ | 141% |
| B5 HOR | 61% | 71% | 87% | 87%★ | 100% | 100%★ | 122% | 122%★ |
| B5 VER | 61%★ | 71%★ | 87%★ | 87% | 100%★ | 100% | 122%★ | 122% |
| A5 HOR | 50% | 58% | 71% | 71%★ | 82% | 82%★ | 100% | 100%★ |
| A5 VER | 50%★ | 58%★ | 71%★ | 71% | 82%★ | 82% | 100%★ | 100% |
| B6 HOR | – | 50% | 61% | 61%★ | 71% | 71%★ | 87% | 87%★ |
| B6 VER | – | 50%★ | 61%★ | 61% | 71%★ | 71% | 87%★ | 87% |
| POSTCARD HOR | – | – | 50% | 50%★ | 58% | 58%★ | 71% | 71%★ |
| POSTCARD VER | – | – | 50%★ | 50% | 58%★ | 58% | 71%★ | 71% |

Fig. 21

| STEPPED CAM | PRESSURE CANCEL CAM | PAPER SIZE |
|---|---|---|
| CAM SURFACE 47a | CAM PLATE 40a | A3 HOR |
| CAM SURFACE 47b | CAM PLATE 40b | B4 HOR |
| CAM SURFACE 47c | CAM PLATE 40c | A4 HOR |
| CAM SURFACE 47d | CAM PLATE 40d | B5 HOR |
| CAM SURFACE 47e | CAM PLATE 40e | A4 VER |
| CAM SURFACE 47f | CAM PLATE 40f | B5 VER |

STENCIL PRINTER HAVING CONTROLLER FOR DISCHARGE TRAY AND MASTER MAKING MEANS

BACKGROUND OF THE INVENTION

The present invention relates to a stencil printer and more particularly to a stencil printer capable of making it needless for the operator of the printer to give consideration to the size or the orientation of papers.

A stencil printer extensively used today includes master making means for perforating, or cutting, a stencil in accordance with image data representative of a document image and thereby producing a master. The master is wrapped around a porous ink drum having ink feeding means arranged thereinside. A pressing member presses a paper or similar recording medium against the ink drum, so that a document image is printed on the paper via the master. The paper with the document image is driven out to a paper discharge tray included in a paper discharge section. Usually, the operator of this type of printer sets a document or documents in the same orientation as papers and then presses a perforation start key for making a master.

Generally, the outer periphery of the ink drum is made up of a porous portion where pores for passing irk therethrough are present and a non-porous portion where a damper for clamping the leading edge of the master is mounted. The porous portion has a length, as measured in the circumferential direction of the ink drum, matching with the maximum size of papers available with the printer, e.g., the maximum length of papers of size A3 prescribed by JIS (Japanese Industrial Standards). The master formed with a document image by the master making means is cut off in a size covering the entire porous portion, e.g., a length matching with size A3 without regard to the size of papers to be used and then wrapped around the ink drum. This, however, brings about the following problems.

Assume that the maximum paper size available with the printer is A3, but the operator desires printings of size A4, and that papers to be used are positioned vertically long. Then, almost one half of the resulting master is simply blank. Such a mater is removed from the ink drum and discarded when printing is to be executed with another document, aggravating the wasteful consumpt ion of a stencil. Further, ink fed from the inside of the ink drum is deposited over the entire area of the master. Therefore, ink deposited on the blank portions of the master is simply wasted together with the master.

In light of the above, Japanese Patent Laid-Open Publication No. 64-18683 proposes a stencil printer capable of varying the length of a master and the duration of contact of a pressing member in accordance with the kind (circumferential length) of an ink drum at the time of making a master and then producing printings with the master. This stencil printer, however, has a problem that it cannot save a stencil unless the ink drum is replaced every time the paper size is changed. In addition, the replacement of the ink drum is troublesome. Another problem is that the operator intending to set a document must check the size and orientation of papers and then set the document in the same orientation as the papers or set papers of the same size as the document, resulting in a troublesome procedure. Should the operator be inattentive, the document and papers might be different in orientation or size, resulting in defective printings.

Japanese Patent Laid-Open Publication No. 10-1254 teaches a stencil printer including a paper discharge tray on which an end fence movable forward and backward in a direction of paper discharge and a pair of side fences movable in the widthwise direction of a paper are mounted. In this kind of printer, paper size sensing means senses the size of papers stacked on a paper feed tray and allows each of the end fence and side fences to be moved to a particular position matching with the paper size. Although this scheme allows papers or printings to be neatly stacked on the paper discharge tray, it also forces the operator to check the orientation of the papers and then set a document in accordance with the orientation of the papers or set papers corresponding in size to the document.

Further, Japanese Patent Laid-Open Publication No. 5-306025 discloses a stencil printer including a plurality of paper feed trays each being loaded with papers of particular size. This allows a plurality of papers of different sizes to be stacked on the paper feed trays. However, the operator must confirm the orientation of papers and that of a document and must replace the papers if papers matching in size with the document are not available.

Moreover, assume that any one of the above conventional stencil printers prints a document image on papers by changing the magnification. Then, if papers having a size great enough to accommodate the resulting document image are not set, the printer cannot operate at all. Even when such papers matching in size with the document image are available in the printer, if they are different in orientation from the document, the operator must change the orientation of the papers or that of the document by troublesome operation.

Technologies relating to the present invention are also disclosed in, e.g., Japanese Patent Laid-Open Publication Nos. 64-24783, 10-193767, and 11-228007.

SUMMARY OF THE INVENTION

It is therefore an object of the present invention to provide a stencil printer capable of producing desirable printings and neatly stacking them without requiring the operator to give consideration to the orientation and size of a document or those of papers.

It is another object of the present invention to provide a stencil printer capable of obviating the wasteful consumption of a stencil and ink with a single ink drum, producing desirable printings and neatly stacking them without regard to the magnification change ratio of a document, and/or producing a greater number of printings efficiently.

In accordance with the present invention, a stencil printer includes an ink drum for wrapping amaster around its outer periphery, a master making section for making the master, a paper discharging section including a paper discharge tray having a pair of side fences spaced from each other in the widthwise direction of a paper and movable in the widthwise direction and an end fence selectively movable forward or backward in the direction of paper discharge, a side fence moving device for moving the side fences in the widthwise direction, an end fence moving device for moving the end fence in the direction of paper discharge, a document size sensing device for sensing the size of a document, a paper size sensing device for sensing the size of the paper, and a controller for controlling the master making device, side fence moving device, and end fence moving device. The controller determines, based on information output from the document size sensing device and paper size sensing device, the orientation the document, the orientation of the paper and the size of the paper and controls, if the document and paper are different in orientation, the master making device on the basis of the orientation of the paper to thereby orient a document image to be formed in the master in accordance with the orientation of the paper, and controls the side fence moving device and end fence moving device for locating each of the side fences and end fence at a particular position matching with the size of the paper.

The control means may determine, based on information output from the document size sensing device and paper size sensing device, the size of the document and the size of the paper and control, if the document and paper are different in size, the master making device on the basis of the size of the paper to thereby automatically change the magnification of a document image to be formed in the master in accordance with the size of the paper, and control the side fence moving device and end fence moving device for locating each of the side fences and end fence at a particular position matching with the size of the paper.

Further, the control means may determine, based on information output from the document size sensing device and paper size sensing device, the orientation and size of the document and the orientation and size of the paper and control, if the document and paper are different in orientation and size, the master making device on the basis of the orientation and size of the paper to thereby form the document image in the master in accordance with the orientation of the paper and automatically change the magnification of the document image in accordance with the size of the paper, and control the side fence moving device and end fence moving device for locating each of the side fences and end fence at a particular position matching with the size of the paper.

BRIEF DESCRIPTION OF THE DRAWINGS

The above and other objects, features and advantages of the present invention will become more apparent from the following detailed description taken with the accompanying drawings in which:

FIG. 6 is a block diagram schematically showing control means included in the illustrative embodiment and sections associated therewith;

FIG. 18 is a block diagram schematically showing control included in the alternative embodiment and sections associated therein;

FIG. 20 is a table listing a relation between magnifications and rotation dependent on a document and a paper; and FIG. 21 is a table listing a relation between paper sizes and cam surfaces and cam plates to be selected.

DESCRIPTION OF THE PREFERRED EMBODIMENTS

Figure 1:
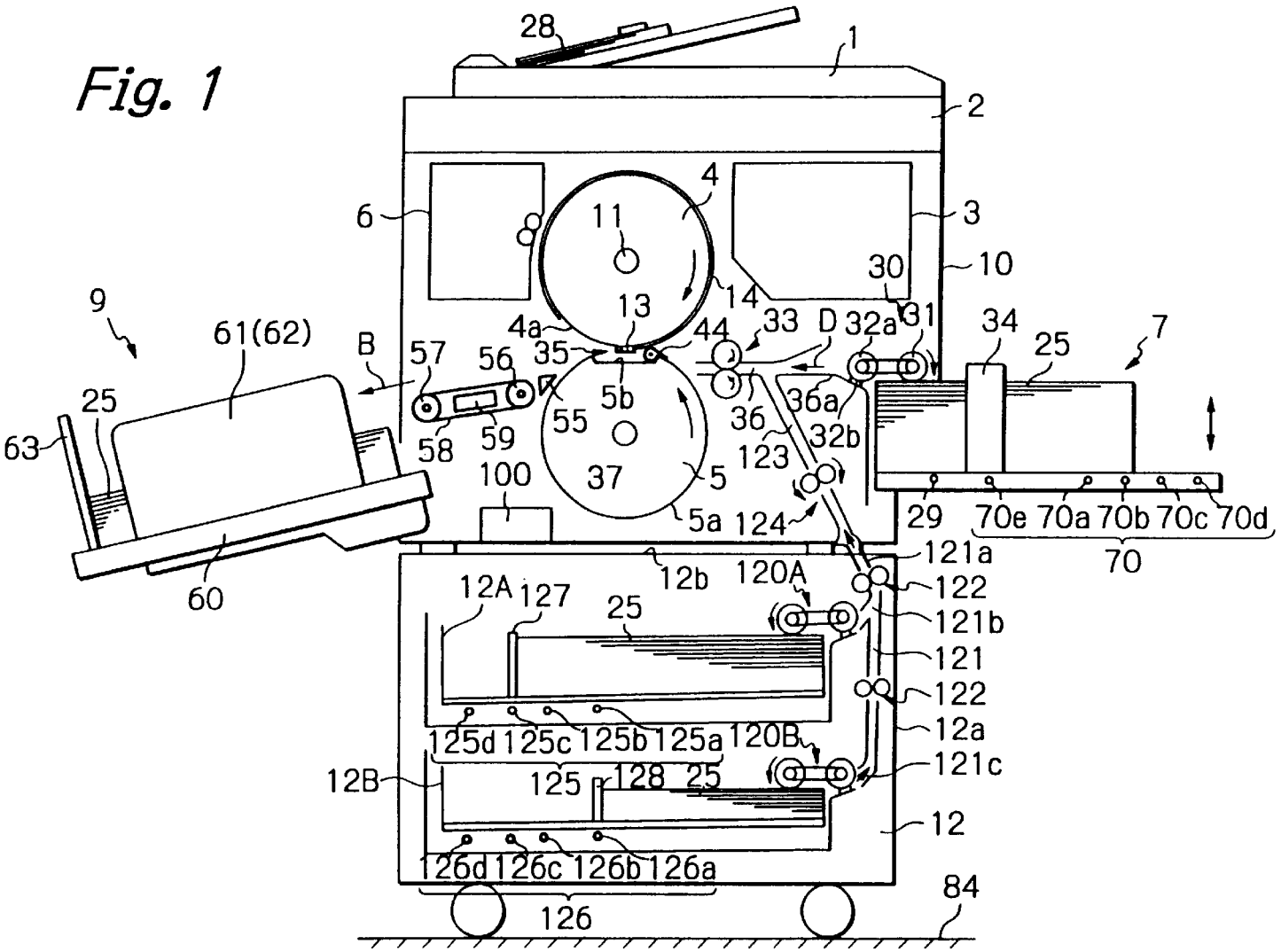
FIG. 1 is a front view showing a stencil printer embodying the present invention.

Referring to FIG. 1 of the drawings, a stencil printer embodying the present invention is shown. As shown, the printer includes a printer body 10 including an ink drum 4, a press drum or pressing member 5, a master discharge unit 6, a paper feed unit 7, and a paper discharge unit 9. The ink drum 4 is caused to rotate by a driveline including a drive motor not shown. The paper feed unit 7 includes a paper feed tray 29 loaded with a stack of papers 25. The paper discharge unit 9 includes a paper discharge tray 60. An ADF (Automatic Document Feeder) 1, an image reading section 2 for optically reading a document 28 and a master making unit 3 are mounted on the printer body 10, implementing an integrated master making and printing type of stencil printer. A multistage paper feed unit 12 is removably mounted to the bottom of the printer body 10 and includes a plurality of paper feed trays 12A and 12B. More specifically, the printer body 10 is mounted on the top 12*b* of the multistage paper feed unit 12 positioned on a floor or similar base 84.

The ink drum 4 is made up of a porous hollow cylinder and a laminate of mesh screens wrapped around the cylinder and is rotatably mounted on a shaft 11. The cylinder has a porous portion extending over a preselected circumferential range (length) of the ink drum 4 and formed with a number of pores, and a non-porous portion on which a camper 13 is positioned. The master making unit 3 perforates, or cuts, a stencil 14 (see FIG. 2) in accordance with image data representative of a document image optically read by the image reading section 2, thereby producing a master 14. The master 14 is wrapped around the outer periphery 4*a* of the ink drum 4 with its leading edge being clamped by the camper 13.

Figure 2:
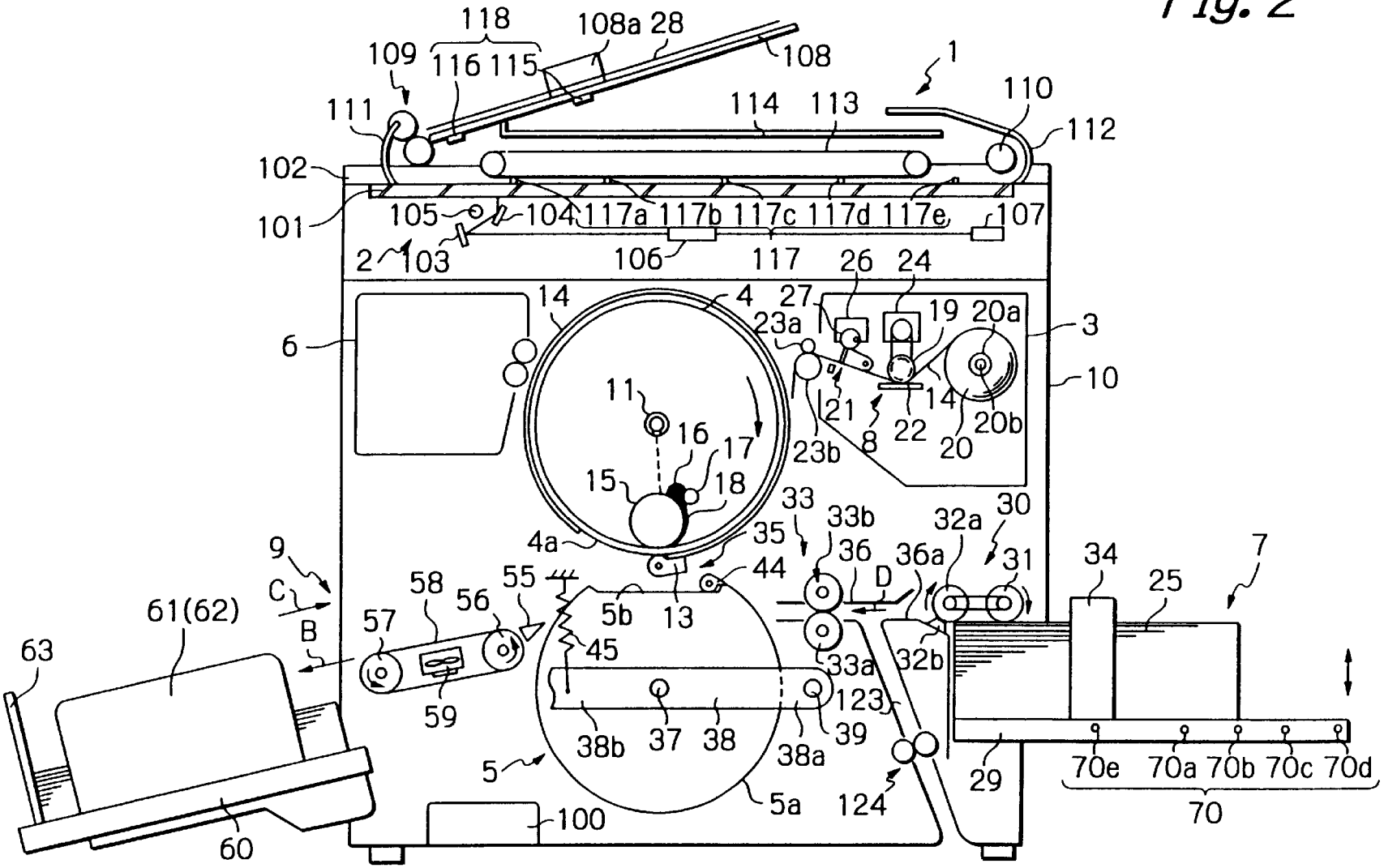
FIG. 2 is an enlarged view showing various sections of a printer body included in the illustrative embodiment.

As shown in FIG. 2, an ink roller 15 and a doctor roller 17 spaced from the ink roller 15 by a small gap are disposed in the ink drum 4. The ink roller 15 is rotatable in synchronism with and in the same direction as the ink drum 4 for feeding ink to the inner periphery of the drum 4. An ink pump, not shown, feeds ink 18 under pressure from an ink pack, not shown, to an ink well 16 formed between the ink roller 15 and the doctor roller 17 via holes formed in the shaft 11. The ink 18 existing in the ink well 16 is fed to the inner periphery of the ink drum 4. The porous portion of the ink drum 4 has a circumferential length over which a paper of size A3 prescribed by JIS can be wrapped lengthwise. The width of the ink drum 4 in the direction parallel to the axis of the drum 4 is greater than the width of the paper of size A3 conveyed lengthwise.

As shown in FIG. 2, the master making unit 3 includes a support shaft 20*b* supporting the stencil 14 implemented as a roll 20. Specifically, the stencil 14 is wound round a tubular core 20*a* to constitute the roll 20. A platen roller 19 pays out the stencil 14 from the roll 20 and conveys it. A thermal head 22 is movable into and out of contact with the platen roller 19. The support shaft 20*b*, platen roller 19 and thermal head constitute master making means 8. A pair of cutter members, or cutting means, cut the stencil 14 at a preselected length. A pair of rollers 23*a* and 23*b* cooperate to convey the leading edge of the stencil or master 14 toward the camper 13. A cutter drive motor 26 causes an eccentric cam 27 to rotate and move the upper cutter member 21 in the up-and-down direction, thereby cutting the stencil 14 at a preselected length.

The platen roller 19 includes a rotatably supported shaft. A platen drive motor 24 is implemented by a stepping motor and rotates the shaft of the platen roller 19, so that the roller 19 conveys the stencil 14 while pressing it against the thermal head 22. The head 22 includes a plurality of heating elements arranged in an array extending in the widthwise direction of the stencil 14. A conventional moving mechanism, not shown, selectively moves the head 22 into or out of contact with the platen roller 19. Specifically, an analog-to-digital converter included in the document reading section 2 and control means 100, which will be described later, output a digital image signal representative of a document image. The head 22 selectively perforates, under the control of the control means 100, the stencil 14 with heat in accordance with the digital image signal, thereby making the master 14.

The master discharge unit 6 is located at the left of the ink drum 4. The master discharge unit 6 removes a used master 14 from the outer periphery 4*a* of the ink drum 4 and collects it as a waste master.

The paper feed unit 7 arranged below the master making section 3 includes the paper feed tray 29, a pick-up roller unit 30, and a registration roller pair 33. The paper feed unit 7 feeds the papers 25 stacked on the tray 29 toward a printing station 35 one by one. The tray 29 is mounted on the right side of the stencil printer 10.

The paper feed tray 29 is mounted on the printer body 10 in such a manner as to be movable up and down. Specifically, an elevating mechanism or elevating means, not shown, raises the tray 29 every time the paper stack 25 on the tray 29 is brought out of its adequate paper feed position. When the paper stack 25 is used up, the above mechanism lowers the tray 29. Reflection type sensors 70*a*, 70*b*, 70*c*, 70*d* and 70*e* constitute a group of paper size sensors 70. A pair of conventional side guides 34 are movable in the widthwise direction of the paper stack 25 for guiding the opposite sides of the stack 25. The sensors 70*a*–70*e* and side guides 34 are mounted on the tray 29.

More specifically, the sensors 70*a*–70*d* each are responsive to the length of the papers 25 in a direction D in which the papers 25 are conveyed (direction of paper conveyance D hereinafter). The sensor 70*e* determines the length of the papers 25 in the widthwise direction of the papers 25 by sensing the position of the side guides 34. Signals output from the sensors 70*a*–70*e* are sent to the control means 100. The control means 100 therefore determines the size and orientation of the papers 25 on the basis of the output signals of the sensors 70*a*–70*e*.

The pick-up roller unit 30 is positioned above the tray 29 and includes a pick-up roller 31 and a separation roller 32*a* each having a surface formed of a high resistance material. A single stepping motor, not shown, rotates the pick-up roller 31 and separation roller 32*a* in the direction indication by arrows in FIGS. 1 and 2 via drive transmitting means including gears and belts not shown. The pick-up roller 31 is held in contact with the top of the paper stack 25 under preselected pressure. A separation member 32*b* is affixed to a guide 36*a* forming the bottom of a first paper transport path 36. The separation roller 32*a* is pressed against the separation member 32*b* by preselected pressure.

The first paper transport path 36 extends from the paper feed unit 7 to the printing station 35. A press drum 5 is positioned below the ink drum 4 and movable into and out of contact with the outer periphery 4*a* of the drum 4. The outer periphery 4*a* of the ink drum 4 and press drum 5 define the printing station 35 therebetween. The separation roller 32*a* and registration roller pair 33 are respectively positioned at the start point and intermediate point of the first transport path 36. As shown in FIG. 2, the registration roller pair 33 is made up of a drive roller 33*a* rotatable in synchronism with the ink drum 4 and a driven roller 33*b* pressed against the drive roller 33*a*. The roller pair 33 drives the paper 25 at such a timing that the leading edge of the paper 25 meets the leading edge of an image formed in the master 14.

Figure 3:
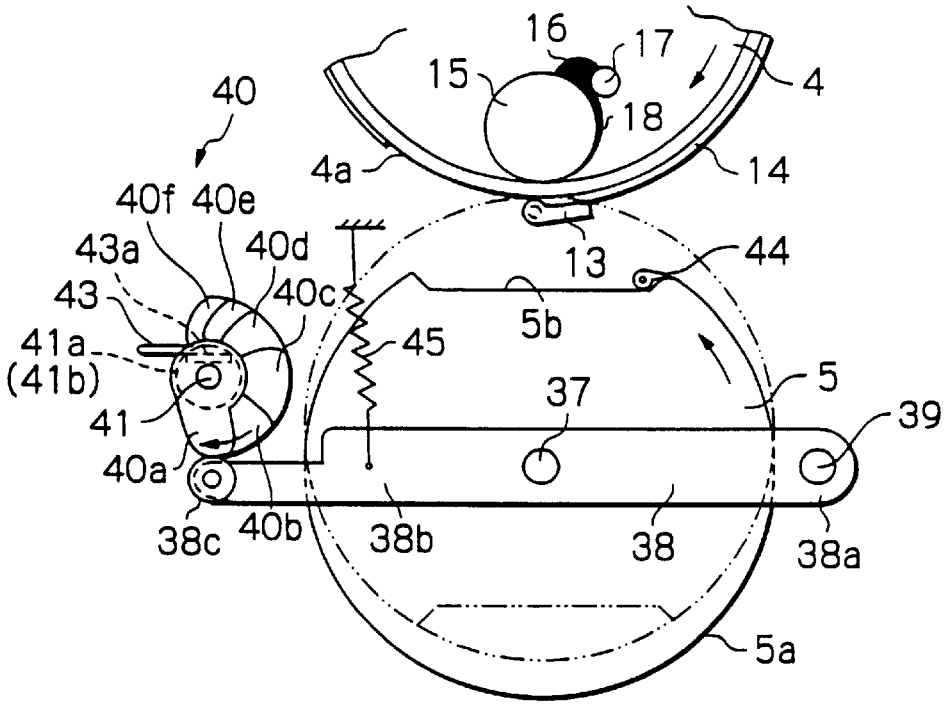
FIG. 3 is an enlarged view showing a pressing member and a mechanism for moving it included in the illustrative embodiment.

As shown in FIGS. 2 and 3, the press drum 5 is operatively connected to a driveline assigned to the ink drum 4 via conventional drive transmitting means including gears or pulleys and belts. The press drum 5 is rotatable counterclockwise at the same peripheral speed as the ink drum 4. The circumference of the press drum 5 is made up of a cylindrical portion 5*a* capable of contacting the ink drun 4 and a flat portion 5*b* formed by notching the above circumference in the form of a letter D. The flat portion 5*b* prevents the press drum 5 from interfering with the camper 13. Specifically, the phase of the ink drum 4 and that of the press drum 5 are preselected such that the damper 13 meets the flat portion 5*b* at the printing station 35. A retainer 44 for temporarily retaining the leading edge of the paper 25 is mounted on one side edge of the flat portion 5*b* and openable away from the circumference of the cylindrical portion 5*a*. Specifically, when the retainer 44 is located around a position where it faces the registration roller pair 33, the retainer 44 is opened and then closed to clamp the leading edge of the paper 25. When the retainer 44 retaining the paper 25 moves away from the printing station 35 due to the rotation of the press drum 5, it is opened to unclamp the paper 25. An opening/closing mechanism, not shown, causes the retainer 44 to perform the above operation.

Shafts 37 are affixed to axially opposite ends of the press drum 5. A pair of arms 38 are spaced from each other in the axial direction of the ink drum 5. The shafts 37 each are rotatably supported by one of the arms 38 via a respective bearing not shown. The arms 38 each are rotatable at one end 38*a* thereof about a shaft 39 affixed to the printer body 10. A tension spring or biasing means 45 is anchored to the other end 38*b* of each arm 38 at one end and to the printer body 10 at the other end. Such tension springs 45 constantly bias the press drum 5 upward toward the ink drum 4. A cam follower 38*c* is rotatably supported by the end of one arm 38 remote from the shaft 39. The press drum 5 may be replaced with any other suitable pressing member, e.g., a conventional press roller movable into and out of contact with the ink drum 4.

Figure 4:
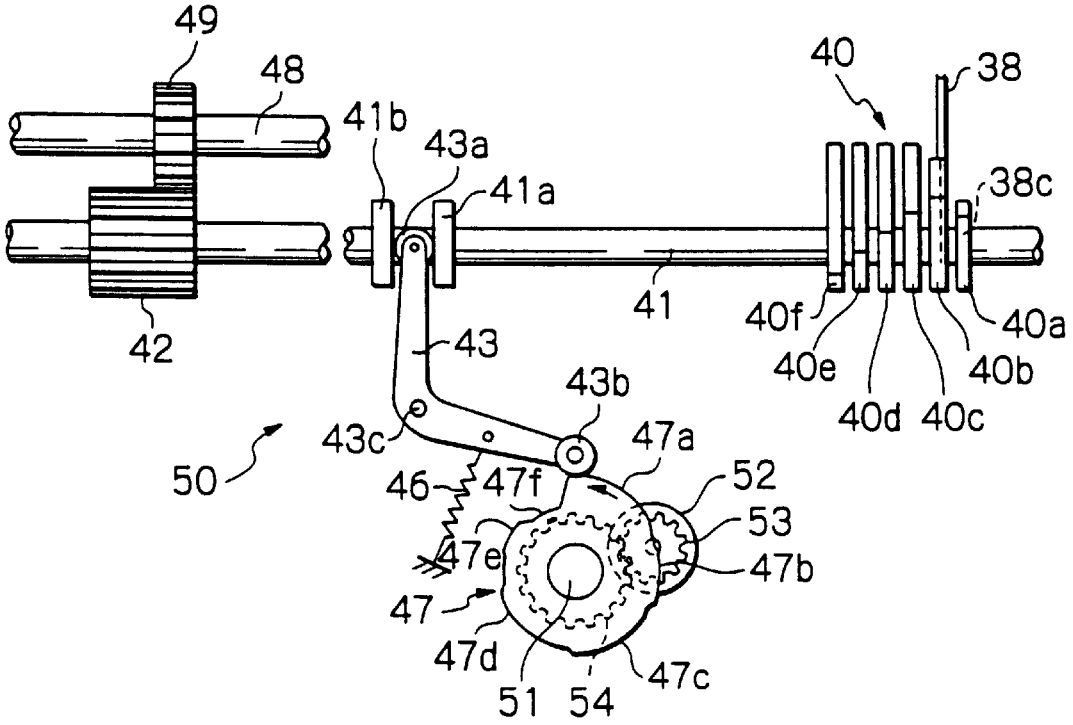
FIG. 4 is an enlarged side elevation showing contact area varying means included in the illustrative embodiment.

A cam 40 for canceling pressure (pressure cancel cam 40 hereinafter) is located in the vicinity of the cam follower 38*c* and made up of six cam plates 40*a*, 40*b*, 40*c*, 40*d*, 40*e* and 40*f*. As shown in FIG. 4, a shaft 41 is supported by the printer body 10 at opposite ends thereof in such a manner as to be rotatable and movable in its axial direction. The cam plates 40*a*–40*f* are mounted on one end portion of the shaft 41 and spaced from each other. The cam plates 40*a*–40*f* are sequentially positioned in this order from the front toward the rear of the shaft, as viewed in FIG. 3. The cam plates 40*a*–40*f* each are made up of a disk-like base portion coaxial with the shaft 41 and a projection protruding from the base portion. The projections of the cam plates 40*a*–40*f* have the same height as measured from the base portions. However, assuming the right edge of the projection of the cam plate 40*a* as a reference, the projections sequentially increase in size in the circumferential direction in the order of the cam plates 40*b*, 40*c*, 40*d*, 40*e* and 40*f*.

As shown in FIG. 4, a drive gear 42 is mounted on the shaft 41. A transmission gear 49 is mounted on a shaft 48 journalled to the printer body 10. Rotation is transferred from the driveline of the ink drum 4 to the pressure cancel cam 40 via the transmission gear 49 and drive gear 42, so that the cam 40 is rotated in the direction indicated by an arrow in FIG. 3.

When any one of the projections of the cam plates 40*a*–40*f* is brought into contact with the cam follower 38*c*, the press drum 5 is moved to the spaced position indicated by a solid line in FIG. 3. When any one of the above projections is released from the cam follower 38*c*, the press drum 5 is brought into pressing contact with the outer periphery 4*a* of the ink drum 4 under the action of the tension springs 45. The base portions of the cam plates 40*a*–40*f* and cam follower 38*c* are so arranged as not to contact each other when the press drum 5 contacts the ink drum 4.

The projections of the cam plates 40*a*–40*f* have circumferential sizes respectively allowing the cylindrical portion 5*a* of the press drum 5 and the outer periphery 4*a* of the ink drum 4 to contact each other over areas, or lengths, matching with the papers 25 of size A3 positioned horizontally long, the papers of size B4 positioned horizontally long, the papers 25 of size A4 positioned horizontally long, the papers 25 of size B5 positioned horizontally long, the papers of size A4 positioned vertically long, and the papers 25 of size B5 positioned vertically long.

As shown in FIG. 4, a generally L-shaped arm 43 and a stepped cam 47 are positioned below the shaft 41. The arm 43 is rotatably mounted on a shaft 43*c* at its bent portion and carries a roller 43*a* and a cam follower 43*b* at opposite ends thereof. A tension spring 46 is anchored at one end to the am 43 between the shaft 43*c* and the cam follower 43*b* and at the other end to the printer body 10, constantly biasing the arm 43 clockwise, as viewed in FIG. 4, about the shaft 43*c*. The roller 43*a* is positioned between a pair of spaced disks 41*a* and 41*b* mounted on the intermediate portion of the shaft 41. The cam follower 43*b* is pressed against the circumference of the stepped cam 47 by the tension spring 46. The distance between the disks 41*a* and 41*b* is slightly greater than the diameter of the roller 43*a*.

The stepped cam 47 is mounted on a shaft 51 journal led to the printer body 10 and has six consecutive cam surfaces 47*a*, 47*b*, 47*c*, 47*d*, 47*e* and 47*f* on its circumference. A gear 54 is mounted on the shaft 51. A gear 53 is mounted on the output shaft of a cam drive motor, or contact area varying drive member, 52 mounted on the printer body 10 and is held in mesh with the gear 54. The motor 52 causes the stepped cam 47 to rotate in the direction indicated by an arrow in FIG. 4. When the motor 52 is energized to rotate the stepped cam 47, the cam 47 causes the arm 43 to angularly move about the shaft 43*c*. As a result, the roller 43*a* mounted on the arm 43 pushes either one of the disks 41*a* and 41*b* and thereby moves the shaft 41 in the axial direction (right-and-left direction in FIG. 4). The motor 52 is implemented by a stepping motor and control led by the control means 100 as to timing.

The stepped cam 47 is so configured as to move the shaft 41 and therefore the pressure cancel cam 40, as follows. When the cam follower 43*b* and cam surface 47*a* contact, the cam plate 40*a* is brought to a position where it is capable of contacting the cam follower 38*c*. When the cam follower 43*b* and cam surface 47*b* contact, the cam plate 40*b* is brought to a position where it is capable of contacting the cam follower 38*c*. When the cam follower 43*b* and cam surface 47*c* contact, the cam plate 40*c* is brought to a position where it is capable of contacting the cam follower 38*c*. When the cam follower 43*b* and cam surface 47*d* contact, the cam plate 40*d* is brought to a position where it is capable of contacting the cam follower 38*c*. When the cam follower 43*b* and cam surface 47*e* contact, the cam plate 40*e* is brought to a position where it is capable of contacting the cam follower 38*c*. Further, when the cam follower 43*b* and cam surface 47*f* contact, the cam plate 40*e* is brought to a position where it is capable of contacting the cam follower 38*c*. Contact area varying means 50 mainly consists of the pressure cancel cam 40 and drive mechanism associated therewith, arm 43, stepped cam 47, and motor 52 for driving the stepped cam 47.

Referring again to FIGS. 1 and 2, a peeler 55, a porous belt 58 and a suction fan 59 are arranged between the press drum 5 and the paper discharge unit 9. The peeler 55 is movable into and out of contact with the cylindrical portion 5*a* of the press drum 5. The belt 58 is passed over a drive roller 56 and a driven roller 57 for conveying the paper 25 removed from the press drum 5 by the peeler 55. A motor, not shown, drives the belt 58 counterclockwise at a speed higher than the peripheral speed of the ink drum 4. In this configuration, the paper 25 moved away from the printing station 35 is removed from the press drum 5 by the peeler 55 and then conveyed by the belt 58 toward the paper discharge unit 9 while being sucked by the suction fan 59.

Figure 5:
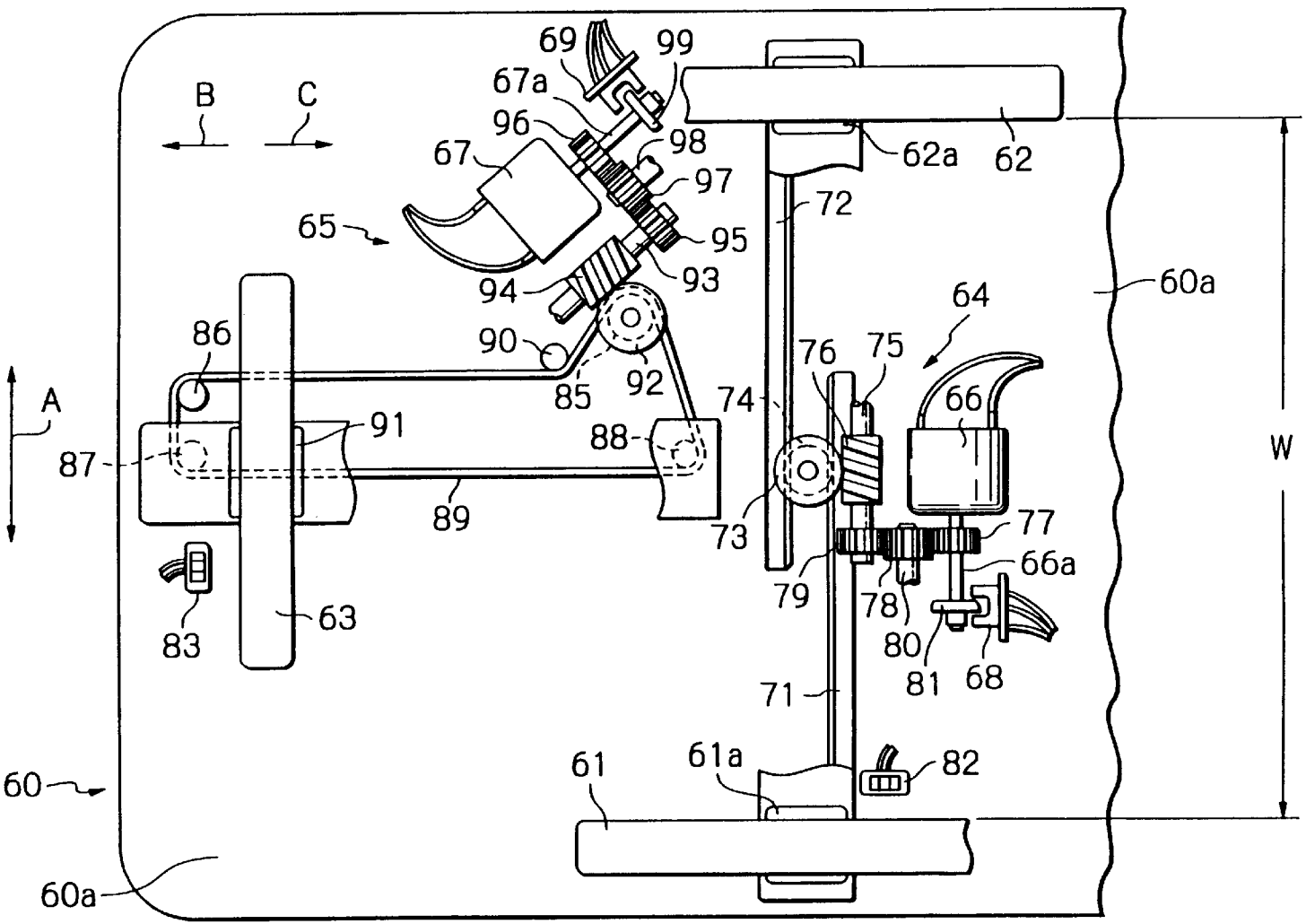
FIG. 5 is an enlarged plan view showing a paper discharge tray and fence moving means included in the illustrative embodiment.

The paper discharge tray 60 protrudes sideways from the printer body 10 for stacking the papers 25 to be sequentially driven out of the printer body 10. The tray 60 includes a pair of side fences 61 and 62 and an end fence 63. As shown in FIG. 5, the side fences 61 and 62 are spaced from each other by a distance W in the widthwise direction of the paper indicated by an arrow A (widthwise direction A hereinafter). The side fences 61 and 62 are movable toward and away from each other in the widthwise direction A. The end fence 63 is located in the direction indicated by an arrow B in which the paper 25 is discharged. The end fence 63 is selectively movable in the direction B or a direction C (forward direction B or backward direction C hereinafter) with respect to the direction of paper discharge.

Mounted on the paper discharge tray 60 are side fence moving means 64, end fence moving means 65, and a side fence drive motor 66, and an end fence drive motor 67. The side fence moving means 64 moves the side fences 61 and 62 in the widthwise direction A. The end fence moving means 65 moves the end fence 63 in either one of the forward direction B and backward direction C. The motors 66 and 67 are specific forms of drive means for driving the side fence moving means 64 and end fence moving means 65, respectively.

The side fence moving means 64 includes a pair of racks 71 and 72 facing each other. The side fences 61 and 62 have their base portions 61*a* and 62*a* affixed to the outer ends of the racks 71 and 72, respectively. The racks 71 and 72, extending in the widthwise direction A, are held in mesh with a pinion gear 74 coaxial with a wheel gear 73. The wheel gear 73 is held in mesh with a worm gear 76 affixed to a shaft 75 which extends in parallel to the rack 71 and is journal led to the tray 60. A gear 79 is mounted on one end of the shaft 75. A drive gear 77 is mounted on the output shaft 66*a* of the side fence drive motor 66 and held in mesh with the gear 79 via a gear 78. The gear 78 is rotatably mounted on a shaft 80 extending in parallel to the shaft 75. A slit plate 81 is affixed to the outer end of the output shaft 66*a*. A side fence sensor 68 senses the rotation of the slit plate 81 while sending its output to the control means 100. The side fence sensor 68 is implemented by a photo interrupter facing the outer circumferential portion of the slit plate 81.

When the side fence motor 66 is energized, the rotation of the output shaft 66*a* is transmitted to the racks 71 and 72 via the gears. When the direction of rotation of the output shaft 66*a* is switched, the racks 71 and 72 are moved in the widthwise direction A.

The end fence moving means 65 includes a drive pulley 85 and driven pulleys 86, 87 and 88. An endless belt 89 is passed over the drive pulley 85 and driven pulleys 86–88 and extends in the forward and backward directions B and C. A tension pulley 90 is positioned in the vicinity of the drive pulley 85 for constantly pressing the belt 89. A slider 91 supporting the end fence 63 is affixed to the belt 89. A wheel gear 92 is coaxial and rotatable integrally with the drive pulley 85. A worm gear 94 is affixed to a shaft 93 and held in mesh with the wheel gear 92. The shaft 93 is journalled to the tray 60 and carries a gear 95 at one end thereof. A gear 96 is mounted on the output shaft 67*a* of the end fence drive motor 67 and held in mesh with the gear 95 via a gear 97. The gear 97 is rotatably mounted on a shaft 98 extending in parallel to the shaft 93. A slit plate 99 is mounted on the end of the output shaft 67*a* while an end fence sensor or photo interrupter 69 is positioned around the outer circumferential portion of the slit plate 99. The end fence sensor 69 senses the rotation of the slit plate 99 while sending its output to the control means 100.

When the end fence drive motor 67 is energized, the rotation of the output shaft 67*a* is transmitted to the belt 89 via the gears. When the direction of rotation of the output shaft 67*a* is switched, the slider 91 is moved in either one of the opposite directions B and C via the belt 89.

A side fence HP (Home Position) sensor 82 and an end fence HP sensor 83 are additionally mounted on the tray 60 for sensing the home positions of the side fences 61 and 62 and end fence 63, respectively. These sensors 82 and 83 each are implemented by a reflection type sensor arranged within the tray 60. Specifically, when the bottom of one side fence or that of the end fence shields the light-sensitive surface of the associated sensor, the sensor outputs an HP sense signal. Usually, the side fences 61 and 62 and end fence 63 each are held at a preselected home position to which the sensor 82 or 83, respectively, is responsive. More specifically, the HP sensors 82 and 83 are so located as to position the side fences 61 and 62 and end fence 63 such that the paper of maximum size available with the tray 60 can be accommodated.

As shown in FIG. 2, the ADF 1 and image reading section 2 are arranged on the top of the printer body 10. The image reading section 2 includes a glass platen 101 on which the document 28 is to be laid, a cover plate 102 angularly movable toward and away from the glass platen 101, mirrors 103 and 1204 and a fluorescent lamp 105 for scanning the document 28, a lens 106 for focusing image light, and a CCD (Charge Coupled Device) image sensor or similar image sensor 107 on which the image light focused by the lens 106 is incident.

Reflection type sensors 117*a*, 117*b*, 117*c*, 117*d* and 117*e* are arranged in the image reading section 2 for sensing the vertical and horizontal lengths of the document 28 laid on the glass platen 101. The sensors 117*a*–117*e* constitute a document size sensor or sensing means 117 in combination. The control means 100 determines, based on the outputs of the sensors 117*a*–117*e*, the size and orientation of the document directly laid on the glass platen 101.

The ADF 1 includes a document feed tray 108 to be loaded with the document or documents 28. A roller pair or feeding means 109 feeds the documents 28 one by one toward the glass platen 101. A plurality of parallel belts 113 convey the document 28 along the glass platen 101. A roller 110 conveys the document 28 read toward a document discharge tray 114. Guides 111 and 112 guide the document 28 being conveyed. In this configuration, the document fed from the document feed tray 108 is conveyed along the glass platen 101 and then driven out to the document discharge tray 114.

A document guide 108*a* is mounted on the document feed tray 108 and movable in the widthwise direction in accordance with the size of the documents 28. A reflection type sensor 115 is positioned below the document guide 108*a* for sensing the position of the guide 108*a*. A reflection type document length sensor 116 is mounted on the underside of the tray 108 in the vicinity of the roller pair 108 for determining the length of the document 28 being conveyed. The two sensors 115 and 116 constitute a document size sensor 118 in combination and output document length information and document width information, respectively. The outputs of the sensors 115 and 116 are sent to the control means 100. The control means 100 determines the length of the document 28 on the basis of the output of the sensor 116 and the duration of operation of the belt 113. In addition, the control means 100 determines, based on the outputs of the sensors 115 and 116, the size and orientation of the document 28 to be conveyed by the ADF 1.

As shown in FIG. 1, the multistage paper feed unit 12 includes pick-up roller units 120A and 120B assigned to the trays 12A and 12B, respectively. The pick-up roller units 120A and 120B respectively feed papers stacked on the trays 12A and 12B one by one. A second transport path 121 guides the paper 25 fed from the tray 12A or 12B into the printer body 10. A plurality of roller pairs 122 are arranged on the second transport path 121. The transport path 121 extends substantially vertically along the right side wall 12*a* of the paper feed unit 12. The transport path 121 has an upper end 121*a* opening at the top 12*b* of the multistage paper feed unit 12 and has an intermediate portion 121*b* and a lower end 121*c* opening in the vicinity of the pick-up roller units 120A and 120B, respectively. A drive motor and a drive transmission mechanism, not shown, drive the pick-up roller units 120A and 120B and roller pairs 122, so that the papers 25 are fed one by one from the tray 12A or 12B to the transport path 121.

The papers 25 stacked on each of the trays 12A and 12B are different in size from the papers 25 stacked on the previously stated tray 29. Of course, one or both of the trays 12A and 12B may be loaded with the papers 25 of the same size as the papers 25 stacked on the tray 29. Further, the papers 25 of the same size may be stacked in a particular orientation on each of the trays 12A and 12B.

As shown in FIGS. 1 and 2, an intermediate transport path 123 is defined in the printer body 10 and provides communication between the first transport path 36 preceding the registration roller pair 33 and the second transport path 121. An intermediate roller pair 124 is positioned at the intermediate portion of the transport path 123 and rotatable in synchronism with the pick-up roller units 120A and 120B by being driven by a motor and a drive transmission mechanism, not shown, mounted on the printer body 10. The paper 25 fed from the paper pick-up unit 12A or 12B is routed through the second transport path 121, intermediate transport path 123 and first transport path 36 to the registration roller pair 33.

The trays 12A and 12B include reflection type sensors 125*a*–125*d* and reflection type sensors 126*a*–126*d*, respectively. The sensors 125*a*–125*d* and sensors 126*a*–126*d* constitute paper size sensors or sensing means 125 and 126, respectively. End guides 127 and 128 are respectively mounted on the trays 12A and 12B, and each is movable for guiding the rear edges of the papers 25 in accordance with the size and orientation of the papers 25. The sensors 125*a*–125*d* and 126*a*–126*d* respectively sense the positions of the end guides 127 and 128 while sending their outputs to the control means 100. In response, the control means 100 determines the size and orientation of the papers 25 stacked on each of the trays 12A and 12B.

FIG. 6 shows a specific configuration of a control panel 130 mounted on the front of the printer body 10 and having various keys arranged thereon. Specifically, numeral keys 131 are used to input various numerical information including aclesired number of printings. A perforation (PERF) start key 132 is used to start a master making operation. A print start key 133 is used to start a printing operation. A power switch (SW) key 136 is used to turn on or turn off a power supply 135. A counter display 137 displays numerical information including the number of printings output. A display 138 is implemented by an LCD (Liquid Crystal Display) for displaying the operating conditions of the printer. A paper size key 139 is used to select the papers 25 of desired size; the key 139 outputs paper size information relating to the papers 25. An automatic magnification change (AUTO MAG) key 140 is used to automatically change the magnification of a document size in matching relation to the paper size. Magnification change ratio inputting means 141 is used to input a desired magnification change ratio of the document size.

More specifically, the magnification change ratio inputting means 141 includes a zoom down key 142 and a zoom up key 143 for respectively reducing and enlarging the document size. Every time the operator presses either one of the keys 142 and 143, the document size changes by 1%. The inputting means 141 additionally includes a reduce (RED) key 145 and an enlarge (ENL) key 144. Every time the operator presses the key 144 or 145, the document size changes regularly in matching relation to the regular size of the papers 25.

The above keys and displays arranged on the control panel 130 are electrically connected to the control means 100. Also electrically connected to the control means 100 are drive control sections, not shown, respectively assigned to the ADF 1, ink drum 4, master discharge unit 6, paper feed unit 7, and multistage paper feed unit 12.

The control means 100 is implemented by a conventional microcomputer including a CPU (Central Processing Unit) 151, a ROM (Read Only Memory) 152, a RAM (Random Access Memory) 153, an image memory 154 for storing a document image read by the document reading section 2 in the form of an image data signal, and image processing means 155. The image memory 154, image reading section 2 and thermal head 22 are connected to the image processing means 155. When the document 28 and papers 25 are different in orientation or size from each other or when the document size is charged in magnification, the control means 100 controls the output to the thermal head 22.

The side fence sensor 68, end fence sensor 69, side fence HP sensor 82, end fence HP sensor 83, document size sensing means 117 and 118 and paper size sensors 70, 125 and 126 are connected to the input side of the CPU 151 by wirings, not shown, and send their outputs to the CPU 151. Connected to the output side of the CPU 151 are the platen roller drive motor 24, cutter drive motor 26, stepped cam drive motor 52, side fence drive motor 66, and end fence drive motor 67 via associated drivers.

The ROM 152 stores motor rotation angle data representative of the reference positions of the side fences 61 and 62 and end fence 63 and each matching with a particular paper size and a particular paper orientation. Also, the ROM 152 stores a magnification change table listing data representative of a relation between the magnification and the rotation dependent on the sizes and orientations of the document 28 and paper 25. Further, the ROM 152 stores a map, not shown, for determining the sizes and orientations of the document 28 and papers 25 on the basis of the outputs of the document size sensing means 117 and 118 and the outputs of the paper size sensors 70, 125 and 126. In response to the outputs of the paper size sensors 70, 125 and 126, the control means searches for the tray 12A, 12B or 29 loaded with the papers 25 of desired size.

Figure 7A:
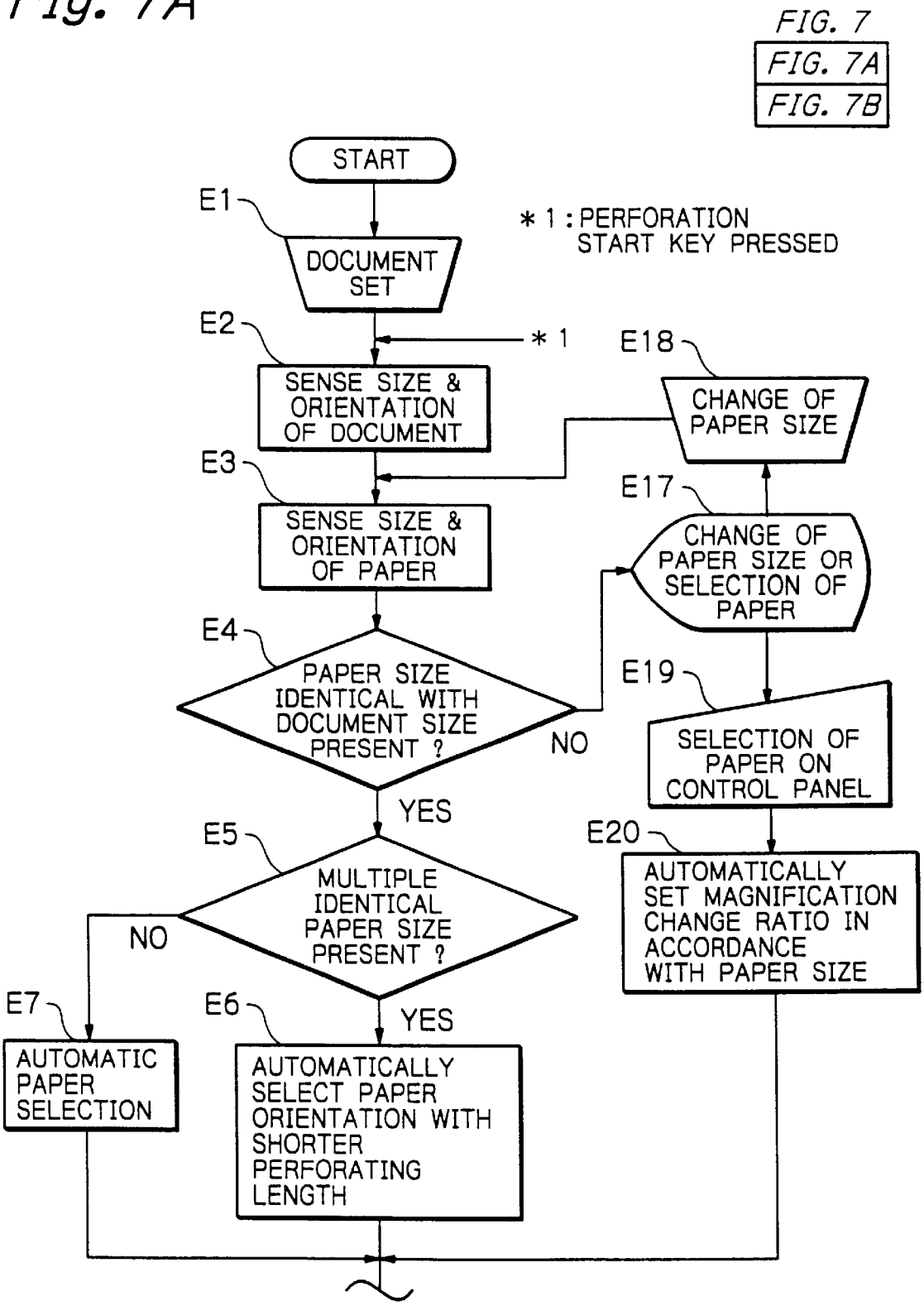
FIG. 7 is a flowchart representative of a x1 automatic paper selection control program to be executed by the control means of the illustrative embodiment.
Figure 7B:
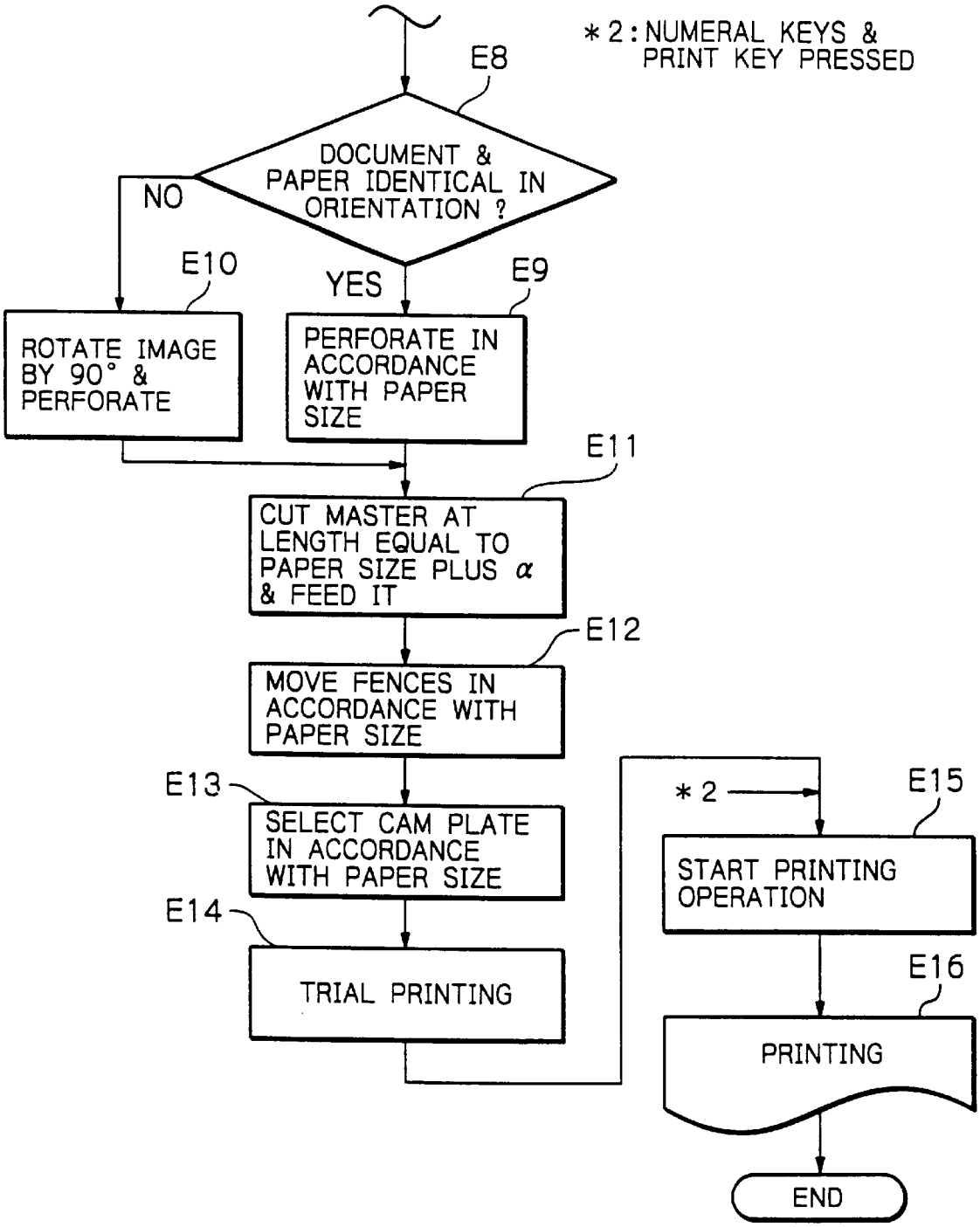
Figures 8, 8A:
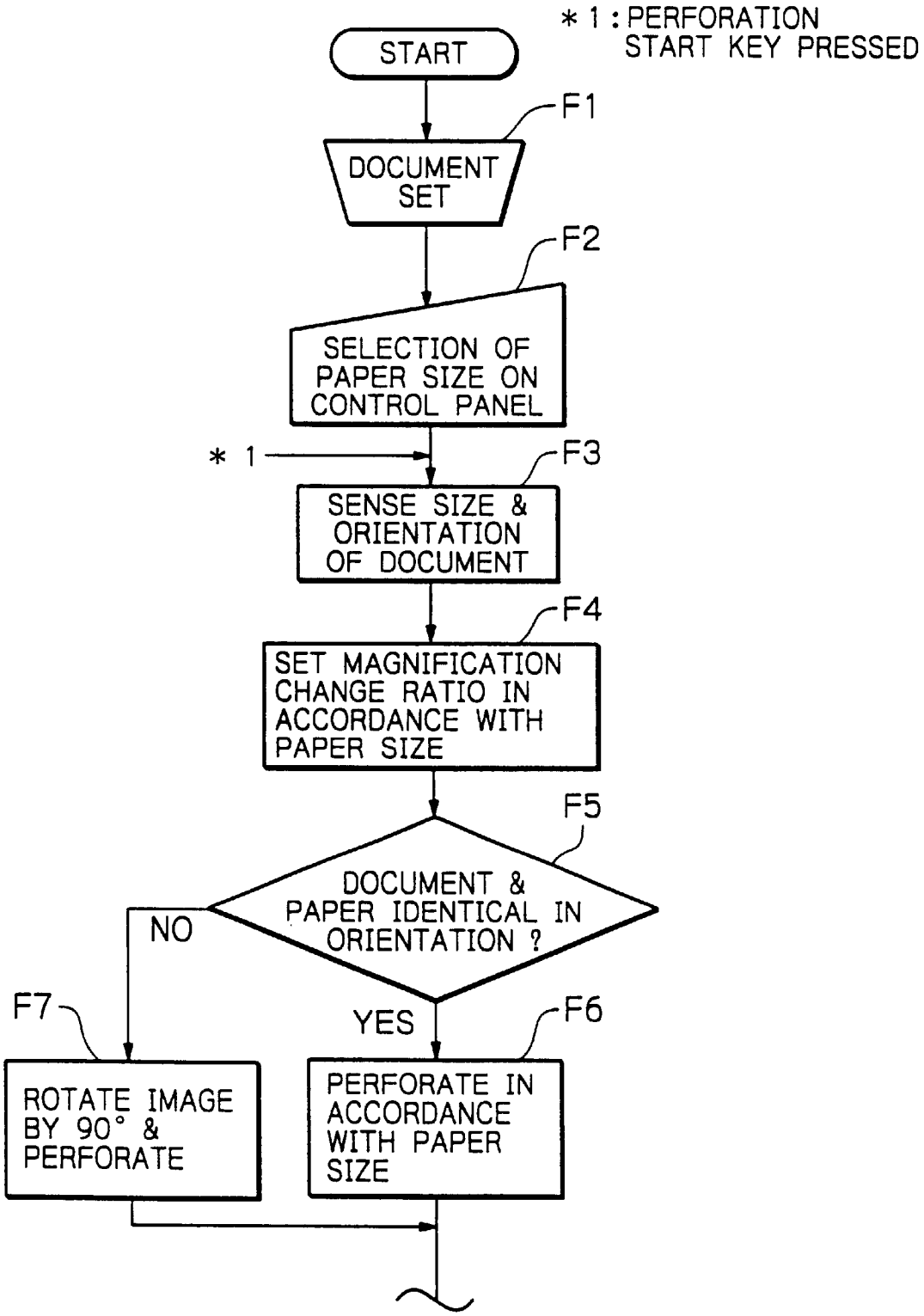
FIG. 8 is a flowchart representative of a paper selection control program to be executed by the control means of the illustrative embodiment.
Figure 8B:
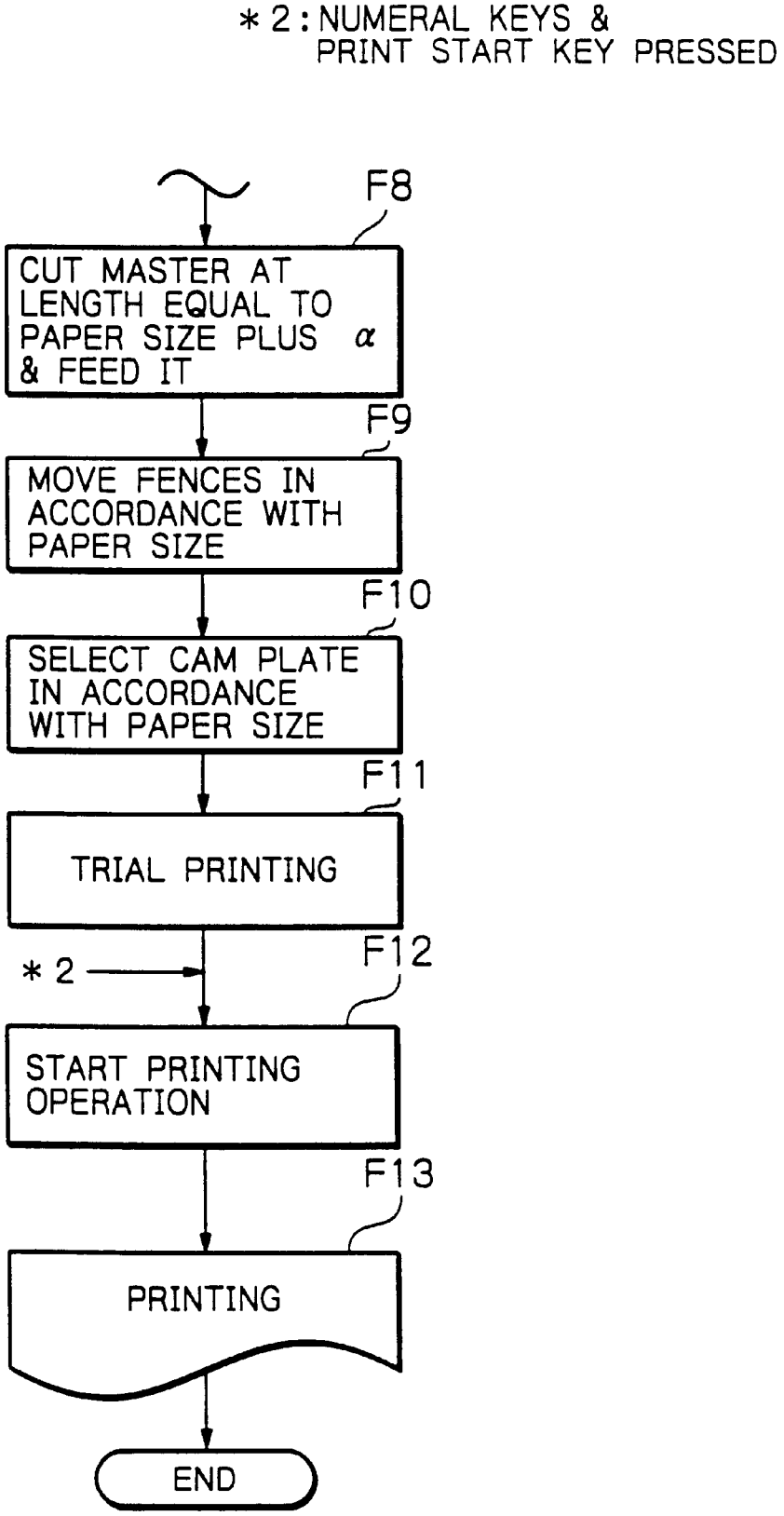
Figures 9, 9A:
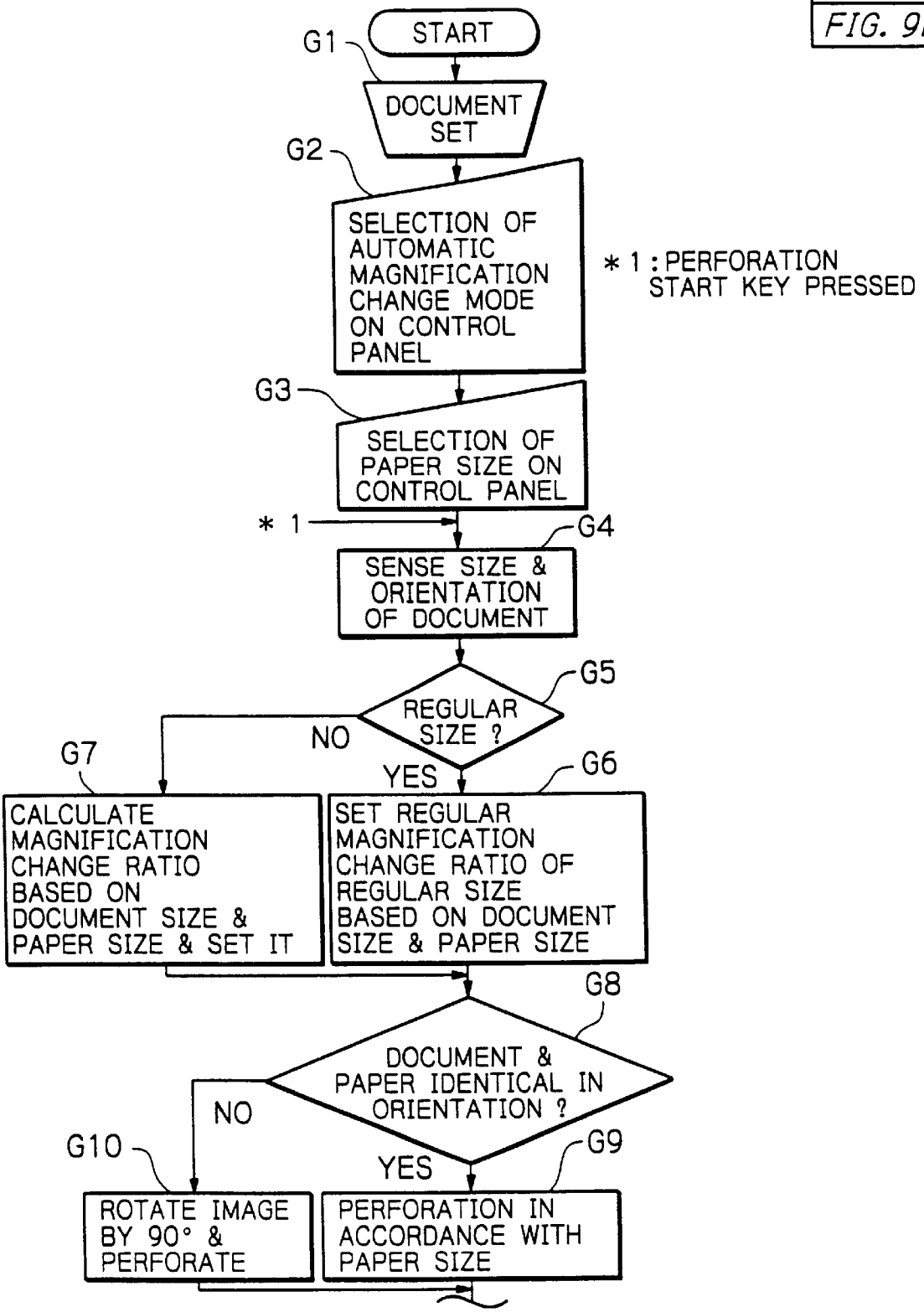
FIG. 9 is a flowchart representative of an automatic magnification change selection control program to be executed by the control means of the illustrative embodiment.
Figure 9B:
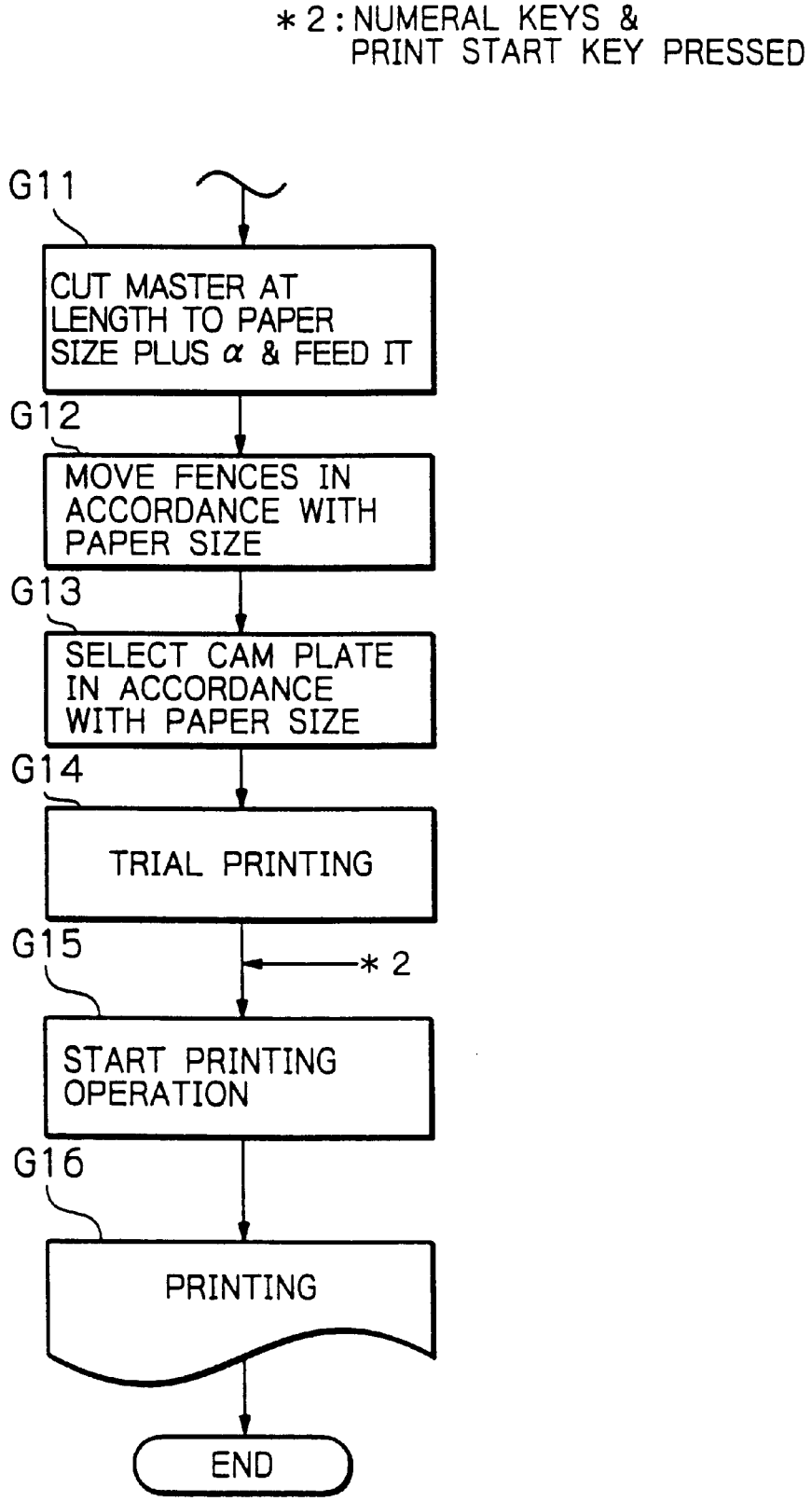
Figures 10, 10A:
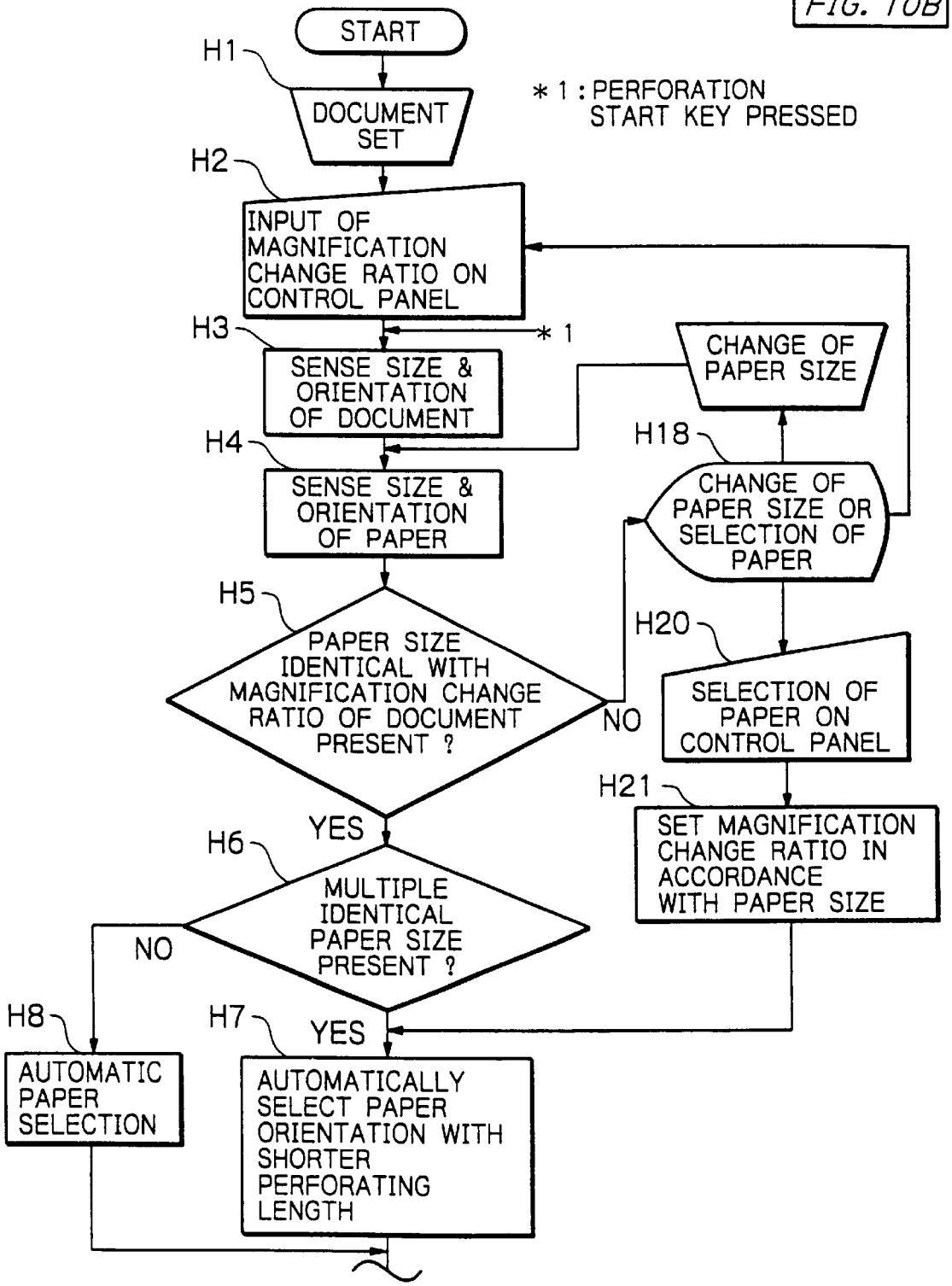
FIG. 10 is a flowchart representative of a magnification change ratio designated control program to be executed by the control means of the illustrative embodiment.
Figure 10B:
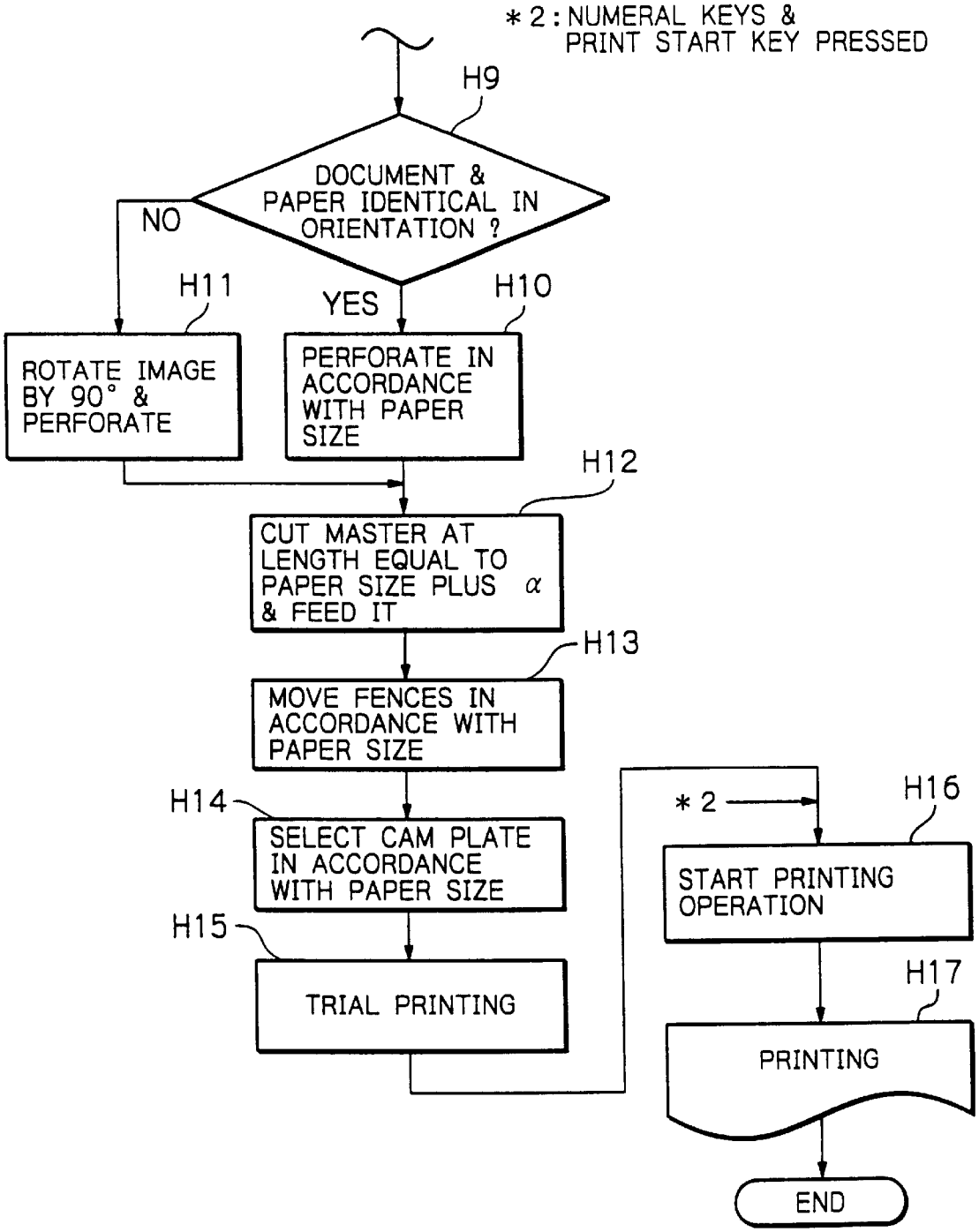

Furthermore, the ROM 152 stores specific programs shown in FIGS. 7, 8, 9 and 10. FIG. 7 shows a x1 automatic paper selection control program for automatically selecting the papers 25 and controlling the contact area varying means 50, side fence moving means 64, and end fence moving means 65. FIG. 8 shows a paper selection control program for controlling the master making unit 3, contact area varying means 50, side fence moving means 64 and end fence moving means 65 in accordance with a paper size selected by the operator. FIG. 9 shows an automatic magnification selection control program for automatically changing the magnification of a document image in accordance with the size of the papers 25 and controlling the master making unit 3, contact area varying means 50, side fence moving means 64, and end fence moving means 65. FIG. 10 shows a magnification ratio designated control program for controlling the master making unit 3, contact area varying means 50, side fence moving means 64 and end fence moving means 65 in accordance with a desired magnification ratio.

The operation of the illustrative embodiment to be executed in accordance with the above programs will be described hereinafter.

As shown in FIG. 7, the operator lays the document 28 on the document feed tray 108 or the glass platen 101, and then presses the perforation start key 132 (step E1). In response, the size and orientation of the document 28 is determined on the basis of the output of the document size sensor 117 or 118 (step E2). At the same time, the sizes and orientations of the papers 25 stacked on the paper feed trays 12A, 12B and 29 are determined on the basis of the outputs oF the paper size sensors 70, 125 and 126 (step E3). When the perforation start key 132 is pressed, the control means 100 drives the document reading section 2 in order to cause it to read the document 28. The resulting image data signal output from the image reading section 2 is written to the image memory 154 via the image processing means 155. If the document 28 is present on the document feed tray 108, then the control means 100 drives the ADF 1 and causes it to convey the document 28 to the glass platen 101 while causing the document reading section 2 to read the document 28. The resulting image data signal is written to the image memory 154 via the image processing means 155.

In a step E4 following the step E3, whether or not the papers 25 of the same size as the document 28 is available on any one of the trays 12A, 12B and 29 is determined on the basis of the above document size and paper size. If the answer of the step E4 is positive (YES), whether or not a plurality of identical paper sizes are present is determined (step E5). If the answer of the step E5 is YES, a paper orientation having a shorter perforating length is automatically selected, i.e., one tray loaded with the papers 25 shorter in the direction of paper conveyance D is automatically selected (step E6). If the answer of the step E5 is negative (NO), the papers 25 of the same size as the document 28 are automatically selected (step E7). The steps E4–E6 constitute a saving operation for saving the stencil and ink.

In a step E8 following the step E6 or E7, whether or not the orientation of the document 28 and that of the papers 25 are coincident is determined. If the answer of the step E8 is YES, a master making operation is executed in matching relation to the paper size (step E9). At this instant, the control means 100 sequentially transfers the image data output from the document reading section 2 to the thermal head 22 without varying the order in which the image data are read out of the image memory 154. At the same time, the control means 100 energizes the platen drive motor 24 in order to pay out the stencil 14 from the roll 20 and perforate it.

If the answer of the step E8 is NO, it is determined that the document 28 is different in orientation from the papers 25 by 90°. This is followed by a step E10 for rotating the document image by 90° and then perforating the stencil 14. Specifically, in the step E10, the image data signal is read out of the image memory 154 in such an order that the image to be formed in the stencil 14 is rotated by 90° in, e.g., the counterclockwise direction. The resulting image data signal is fed to the thermal head 22 via the image processing means 155. Consequently, the image to be formed in the stencil 14 is rotated counterclockwise by 90° to coincide in orientation with the papers 25.

As stated above, when the document 28 and papers 25 are of the same size, but different in orientation, a rotated image is formed in the stencil 14. The operator can therefore obtain an image coincident in orientation with the papers 25 without giving any consideration to the orientation of the document 28 or that of the papers 25. This obviates defective printings ascribable to a difference in orientation between the papers 25 and the printed image.

After the step E9 or E10, the perforated stencil or master 14 is cut off at a preselected length which is the paper size selected plus a (step E11). More specifically, the control means 100 controls the platen roller drive motor 24 and cutter drive motor 26 such that the master 14 has a length slightly greater than the length of the papers 25 in the direction of paper conveyance D. In parallel with the feed of such a master 14, the ink drum 4 is rotated at a lower speed than at the time of printing. When the ink drum 4 reaches a preselected position, the damper 13 is opened and then closed to clamp the leading edge of the master 14. As a result, the master 14 is sequentially wrapped on the outer periphery 4*a* of the ink drum 4. This makes it needless to replace the ink drum 4 in accordance with the master size or the paper size and thereby obviates the wasteful consumption of the stencil and ink.

After the step E11, the side fences 61 and 62 and end fence 63 on the paper discharge tray 60 are moved in accordance with the paper size selected (step E12). Specifically, the control means 100 rotates the side fence drive motor 66 and end fence drive motor 67 until the side fence sensor 68 and end fence sensor 69 each sense a particular rotation angle implementing a reference position matching with the paper size. When the sensors 68 and 69 sense such rotation angles, the control means 100 stops rotating the motors 66 and 67. That is, the side fences 61 and 62 and end fence 63 each are automatically moved from the respective home position to the reference position matching with the paper size. This frees the operator from manual operation taking account of the sizes and orientations of the document 28 and papers 25.

The step E12 is followed by a step E13 for selecting one of the cam plates of the pressure cancel cam 40 in accordance with the paper size selected. Specifically, the control means 100 controls the direction and amount (angle) of rotation of the stepped cam drive motor 52 so as to select an adequate position of the stepped cam 47. That is, one of the cam plates 40*a*–40*f* matching with the length of the master 14, i.e., the length of the papers 25 in the direction of paper conveyance D and expected to contact the cam follower 38*c* is selected. Consequently, the circumferential range of the ink drum 4 over which the press drum 5 is expected to contact is limited to the range defined by the length in the above direction D. This prevents the press drum 5 from contacting the porous portion of the ink drum 4 not covered with the master 14; otherwise, the press drum 5 and its neighborhood would be smeared by the ink.

After the master 14 has been fully wrapped around the ink drum 4 and the adequate cam plate of the cam 40 has been selected, a trial printing operation is executed (step E14). Specifically, the control means 100 again causes the ink drum 4 to rotate at a lower speed than during printing. At the same time, the control means 100 controls the press drum 5, retainer 44, and the pick-up roller unit assigned to the paper feed tray loaded with the papers 25 of the size selected. For example, assume that the papers 25 of the size selected are present on the tray 29, as shown in FIG. 2. Then, the control means 100 causes the pick-up roller unit 30 to rotate the pick-up roller 31 and separation roller 32 in the directions indicated by arrows in FIG. 2. As a result, the top paper 25 is fed from the tray 29 to the registration roller pair 33 via the first transport path 36. The registration roller pair 33 drives the paper 25 toward the printing station 35 at a preselected timing. The retainer 44 temporarily retains the leading edge of the paper 25. At this time, the press drum 5 is pressed against the ink drum 4 over the preselected contact range with the result that the ink is transferred from the drum 4 to the paper 25. The paper 25 moved away from the printing station 35 is removed from the press drum 5 by the peeler 55, belt 58 and suction fan 59 and driven out of the printer body 10. Finally, the paper 25 is laid on the paper discharge tray 60 by being guided by the side fences 61 and 62 and end fence 63.

If the paper or trial printing 25 produced by the above step is acceptable, the operator inputs a desired number of actual printings on the numeral keys 131 and then presses the print start key 133. In response, a printing operation begins (step E15) and produces printings (step E16). Specifically, the control means 100 rotates the ink drum 4 at a printing speed and thereby causes the image formed in the master 14 to be sequentially formed on the number of papers 25 (fed from the tray 29) equal to the desired number of printings. This is the end of the control. The papers or printings 25 sequentially driven out of the printer body 10 are neatly positioned on the paper discharge tray 60 by the side fences 61 and 62 and end fence 63 adequately positioned beforehand.

Assume that none of the papers 25 stacked on the paper feed trays 12A, 12B and 29 is of the same size as the document 28 (NO, step E4). Then, the operator is urged to replace the papers 25 different in size from the document 28 with papers 25 of the same size as the document 28. When the operator replaces, e.g., the papers 25 stacked on the tray 29 with papers of the same size as the document 28, the step E4 is transferred to the step E7 via the steps E5. On the other hand, when the operator replaces not only the papers stacked on the tray 29 but also the papers 25 stacked on at least one of the trays 12A and 12B, the step E4 is transferred to the step E8 via the steps E5 and E6. Subsequently, the orientation of the document 28 is determined (step E8). If the answer of the step E8 is YES, the step E9 is executed. If the answer of the step E8 is NO, the step E10 is executed.

Assume that the operator selects one of the existing papers 25 (step E17). Then, the operator presses the paper size key on the control panel 130, FIG. 6, for selecting the desired papers 25, i.e., the tray loaded with the desired papers 25. In this case, a magnification change ratio matching with the size of the desired papers 25 is automatically set (step E20). Specifically, referencing a magnification change ratio table shown in FIG. 20, the control means 100 automatically sets a magnification change ratio which confines the document image in the paper size selected by the operator.

The step E20 is followed by the step E8. In the step E9 following the step E8, the image processing means 155 transforms the image data signal read out of the image memory 154 on the basis of the magnification change ratio and delivers the transformed signal to the thermal head 22. As a result, the document image is formed in the stencil 14 in a size matching with the paper size.

If the answer of the above step E8 is NO, the image processing means 155 transforms the image data signal read out of the image memory 154 in accordance with the magnification change ratio such that the image to be formed in the stencil 14 is rotated by 90°. Also, the image data signal is read out of the image memory 154 in a different order. Consequently, a document image rotated by 90° and capable of being confined in the paper size is formed in the stencil 14.

The magnification change ratio table shown in FIG. 20 is representative of a relation between the magnification change ratio and the rotation dependent on the document size and paper. FIG. 2, tabulates a relation between the paper size and the cam surface and cam to be selected.

Figure 11:
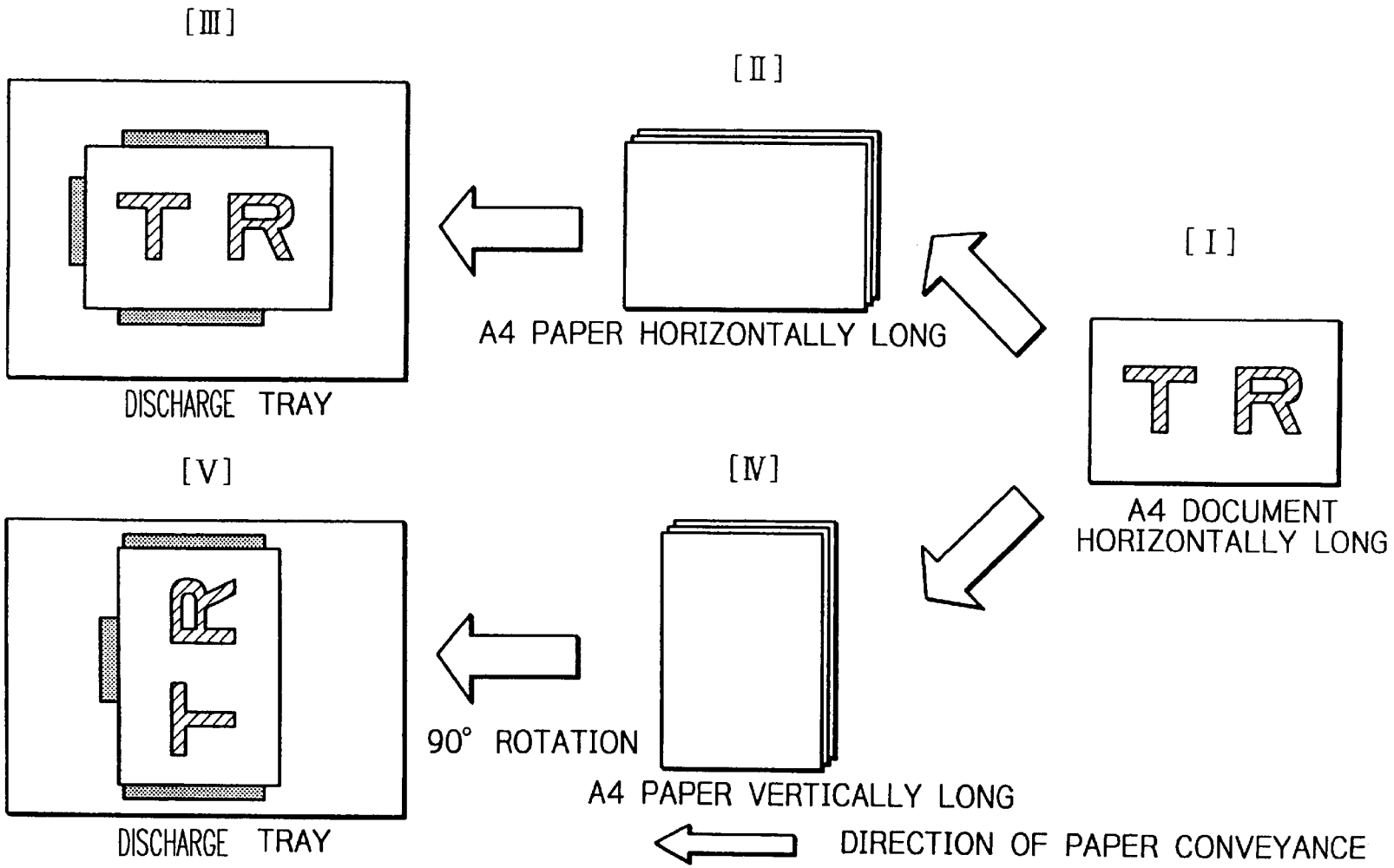
FIG. 11 is a view demonstrating a master making operation and control over the paper discharge tray to be executed when a document size and a paper size are identical.

The control program of FIG. 7 will be described more specifically with reference to FIGS. 11 and 12. Assume that the document 28 of size A4 is positioned horizontally long along the edge of the glass platen 101, as shown in FIG. 11, [I], and that the papers 25 stacked on the paper feed tray 29 are also of size A4 and positioned horizontally long, as shown in FIG. 11, [II]. Then, because the papers 25 and document 28 are of the same size and oriented in the same direction, the control program advances to the step E9 and forms the document image in the stencil 14 without rotating it. In this case, the cam plate 40*c* of the cam 40 assigned to the A4 horizontal size is selected while the side fences 61 and 62 and end fence 63 are held at positions shown in FIG. 11, [III], matching with the A4 horizontal size. Consequently, the papers 25 with images identical in orientation with the document image are sequentially stacked on the paper discharge tray 60 while being neatly guided by the fences 61, 62 and 63.

On the other hand, assume that the papers 25 of size A4 are stacked on the paper feed tray 12A vertically long, as shown in FIG. 11, [IV]. In this case, the trays 12A and 29 both are loaded with the papers 25 of the same size as the document 28. Therefore, the control program advances from the step E5 to the step E6 for selecting the papers 25 of A4 horizontal size having a shorter perforating length, i.e., shorter in the direction of paper conveyance D. However, the orientation of these papers 25 is different from the orientation of the document 28. The control program therefore executes the step E10 for rotating the document image by 90° before perforation. In this case, the cam plate 40*e* of the cam 40 assigned to the A4 vertical size is selected while the side fences 61 and 62 and end fence 63 are held at positions shown in FIG. 11, [V], matching with the A4 vertical size. Consequently, the document image is rotated by 90° and then printed on the above papers 25 in adequate orientation. Again, the resulting printings 25 are sequentially stacked on the paper discharge tray 60 while being neatly guided by the fences 61, 62 and 63.

Figure 12:
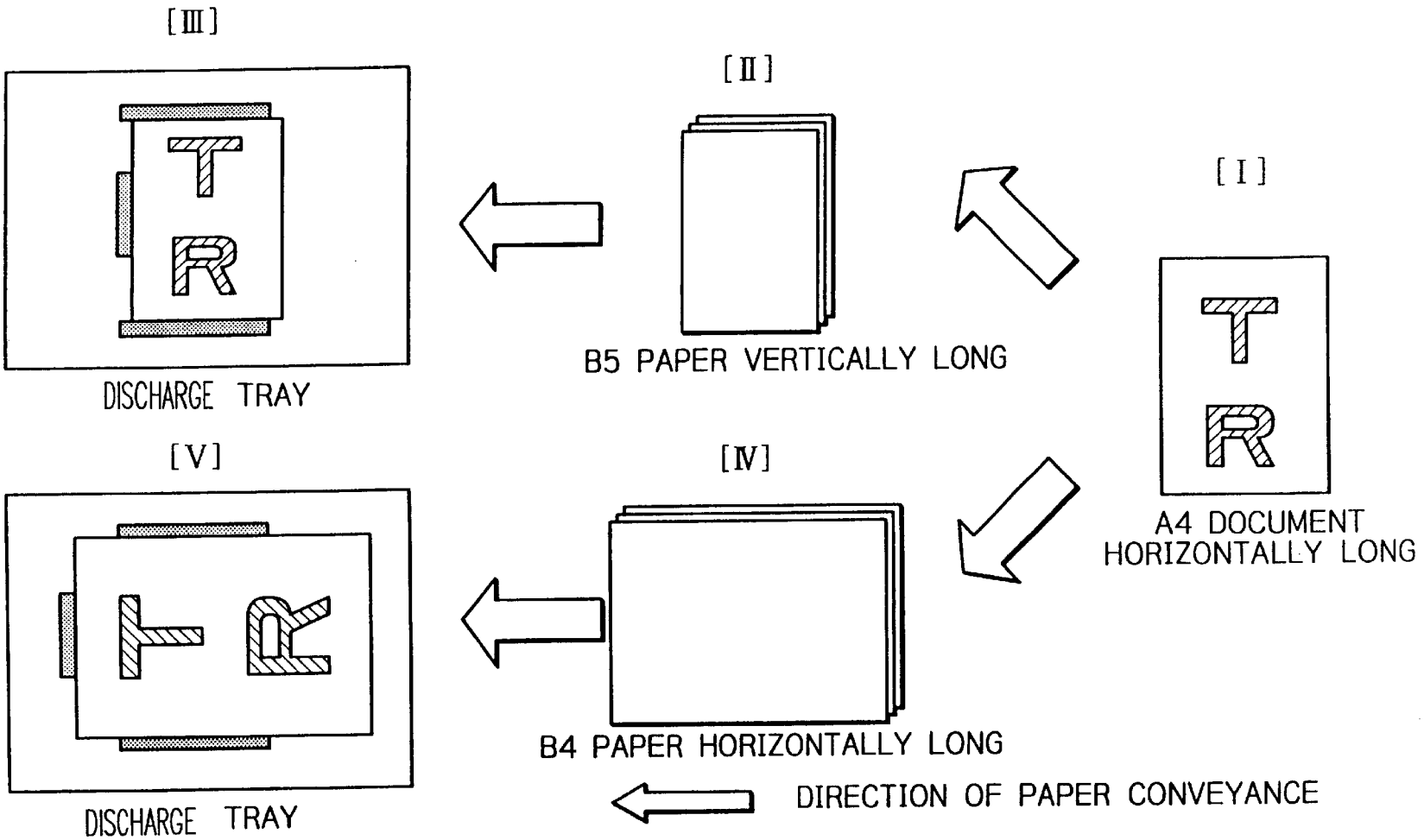
FIG. 12 is a view demonstrating a master making operation and control over the paper discharge tray to be executed when a document size and a paper size are different.

Assume that a document 28 of size A4 is laid on the glass platen 101 vertically long along the edge of the glass platen 101, as shown in FIG. 12, [I], that papers 25 of size B5 are stacked on the tray 12A vertically long, as shown in FIG. 12, [II], and that papers 25 of size B4 are stacked on the tray 12B horizontally long, as shown in FIG. 12, [IV]. Further, assume that papers 25 of size A4 are absent on the tray 29.

The operator stacks papers 25 of size A4 on the tray 29 (step E18) or selects the papers 25 stacked on either one of the trays 12A and 12B on the paper size key 139. Assume that the operator selects the papers 25 of size B5 stacked on the tray 12A vertically long, as shown in FIG. 12, [II]. Then, the control program automatically sets a magnification change ratio of 87% (step E20). In this case, the papers 25 and document 28 are identical in orientation, so that the operation is transferred from the step E20 to the step E9 without rotating an image to be formed. The cam plate 40*f* of the cam 50 is selected in matching relation to the B5 vertical size. As shown in FIG. 12, [III], the side fences 61 and 62 and end fence 63 each are located at a position corresponding to the B5 vertical size. Consequently, images are printed on the papers 25 in a size reduced by 87%. The papers with such images or printings 25 are neatly stacked on the paper discharge tray 60 by being disirably guided by the side fences 61 and 62 and end fence 63.

When the operator selects the papers 25 of size B4 stacked on the paper feed tray 12B horizontally long, as shown in FIG. 12, [IV], the control means 100 automatically sets a magnification change ratio of 122% in the step E20. Again, the document image is rotated by 90° because the document 25 and the above papers 25 are different in orientation (see FIG. 20). In this case, the cam plate 40*b* of the cam 40 assigned to the B4 horizontal size is selected while the side fences 61 and 62 and end fence 63 are held at positions shown in FIG. 12, [V], matching with the B4 horizontal size. The resulting printings 25 with images enlarged by 122% and rotated by 90° are sequentially stacked on the paper discharge tray 60 while being neatly guided by the fences 61, 62 and 63.

The paper selection control program shown in FIG. 8 is as follows. The operator lays the document 28 on the document feed tray 108 or the glass platen 101 (step F1), and then presses the paper size key 139 to select the tray loaded with the papers 25 of desired size (step F2). When the operator presses the perforation start key 132, the control means 100 determines the size and orientation of the document 28 on the basis of the output of the document size sensor 117 or 118 (step F3). When the perforation start key 132 is pressed, the control means 100 drives the document reading section 2 in order to cause it to read the document 28. The resulting image data signal output from the image reading section 2 is written to the image memory 154 via the image processing means 155.

In a step F4 following the step F3, referencing the magnification change ratio table of FIG. 20, the control means 100 automatically selects a magnification change ratio matching with the paper size selected, so that a document image can be accommodated in the paper size. Subsequently, the control means 100 determines the orientation of the document 28 and that of the papers 25 (step F5). Specifically, if the answer of the step F5 is YES, a master making operation is executed in matching relation to the paper size (step F6). At this instant, the control means 100 sequentially transfers the image data output from the document reading section 2 to the thermal head 22 in accordance with the magnification change ratio without varying the order in which the image data are read out of the image memory 154. At the same time, the control means 100 energizes the platen drive motor 24 in order to pay out the stencil 14 from the roll 20 and perforate it.

If the answer of the step F5 is NO, the document image is rotated by 90° and then formed in the stencil 14 (step F7). Specifically, the image data signal is read out of the image memory 154 in such an order that the image to be formed in the stencil 14 is rotated by 90° in, e.g., the counterclockwise direction. The resulting image data signal is fed to the thermal head 22 via the image processing means 155. Consequently, the image to be formed in the stencil 14 is rotated counterclockwise by 90° to coincide in orientation with the papers 25.

After the step F6 or F7, the perforated stencil or master 14 is cut off at a preselected length which is the paper size selected plus $\alpha$ (step F8). After the step F8, the side fences 61 and 62 and end fence 63 on the paper discharge tray 60 are moved in accordance with the paper size selected (step F9). After the step F9, adequate one of the cam plates of the cam 40 matching with the paper size is selected (step F10). This is followed by the previously stated trial printing operation (step F11). If the paper or trial printing 25 produced by the above step is acceptable, the operator inputs a desired number of actual printings on the numeral keys 131 and then presses the print start key 133. In response, a printing operation begins (step F12) and produces printings (step F13). This is the end of the control. The steps F8–F13 are identical with the step E11 and successive steps of FIG. 7 and will not be described specifically in order to avoid redundancy.

As stated above, even when the operator selects a desired paper size, the control means 100 executes control based on the table of FIG. 20 such that the document image matches in size with the papers 25 selected. If the document 28 and papers 25 are different in orientation, the control means 100 rotates the document image by 90°. Further, the master 14 is cut off at a length matching with the paper size. This, coupled with the fact that the cam plate of the cam 40 matching with the paper size is selected, makes it needless to replace the ink drum 4 in accordance with the master size or the paper size. The operator therefore does not have to care about the orientation and size of the document 25 or those of the papers 25. It follows that the above program promotes easy and efficient operation, reduces defective printings, and obviates the wasteful consumption of stencil and ink. In addition, the fences of the paper discharge tray 60 are adequately located to insure neat stacking of the papers or printings 25.

The automatic magnification selection control program of FIG. 9 will be described specifically hereinafter. As shown, the operator lays the document 28 on the document feed tray 108 or the glass platen 101 (step G1), presses the automatic magnification change key 140 on the control panel 130, FIG. 6, for selecting an automatic magnification change mode (step G2), and presses the paper size key 139 for selecting the tray loaded with the papers of desired size (step G3). When the operator presses the perforation start key 132, the control means 100 determines the size and orientation of the document 28 on the basis of the output of the document size sensor 117 or 118 (step G4). Again, when the perforation start key 132 is pressed, the control means 100 drives the document reading section 2 in order to cause it to read the document 28. The resulting image data signal output from the image reading section 2 is written to the image memory 154 via the image processing means 155.

In a step G5 following the step G4, the control means 100 determines whether or not the papers 25 selected are of regular size. Specifically, the control means 100 may determine whether or not the paper size exists in the table of FIG. 20 or may compare regular size information stored in the ROM 152 and the above paper size.

If the answer of the step G5 is YES, the control means 100 sets, based on the table of FIG. 20, a regular magnification change ratio matching with the document size and paper size (step G6). If the answer of the step G5 is NO, the control means 100 calculates a magnification change ratio on the basis of the document size and paper size and sets the calculated ratio (step G7). Specifically, in the step G7, the operator inputs the vertical and horizontal dimensions of the papers 25 of irregular size on the numeral keys 131. The control means 100 calculates a magnification change ratio for the papers 25 of irregular size by using the above dimensions and vertical and horizontal dimensions of document sizes stored in the ROM 152 beforehand. Alternatively, to set a magnification change ratio for the papers 25 of irregular size, the ratio may be implemented by smaller one of a/c and b/d where a and b are respectively the vertical and horizontal dimensions of the document 28 while c and d are respectively the vertical and horizontal dimensions of the papers 25.

After the steps G6 and G7, the control means 100 determines the orientation of the document 28 and that of the papers 25 (step G8). If the document 28 and papers 25 are identical in orientation (YES, step G8), the control means 100 executes a master making operation in matching relation to the paper size (step G9). In this case, the control means 100 delivers the image data signal output from the image reading section 2 to the thermal head 22 via the image processing means 155 in accordance with the regular magnification change ratio without varying the order of reading of the signal out of the image memory 154. At the same time, the control means 100 drives the platen drive motor 24 for causing the master 14 to be selectively perforated while being conveyed. Consequently, the image to be formed in the stencil 14 is reduced in size if the paper size is smaller than the document size or is enlarged in size if the former is greater than the latter (see FIG. 20).

If the answer of the step G8 is NO, the document image is rotated by 90° and then formed in the stencil 14 (step G10). Specifically, the image data signal is read out of the image memory 154 in such an order that the image to be formed in the stencil 14 is rotated by 90° in, e.g., the counterclockwise direction. The resulting image data signal is fed to the thermal head 22 via the image processing means 155 in accordance with the magnification change ratio for the irregular size. Consequently, the image to be formed in the stencil 14 corresponds to the irregular size and is rotated counterclockwise by 90° to coincide in orientation with the papers 25.

After the step G9 or G10, the perforated stencil or master 14 is cut off at a preselected length which is the paper size selected plus $\alpha$ (step G11). After the step G11, the side fences 61 and 62 and end fence 63 on the paper discharge tray 60 are moved in accordance with the paper size selected (step G12).

Figure 13:
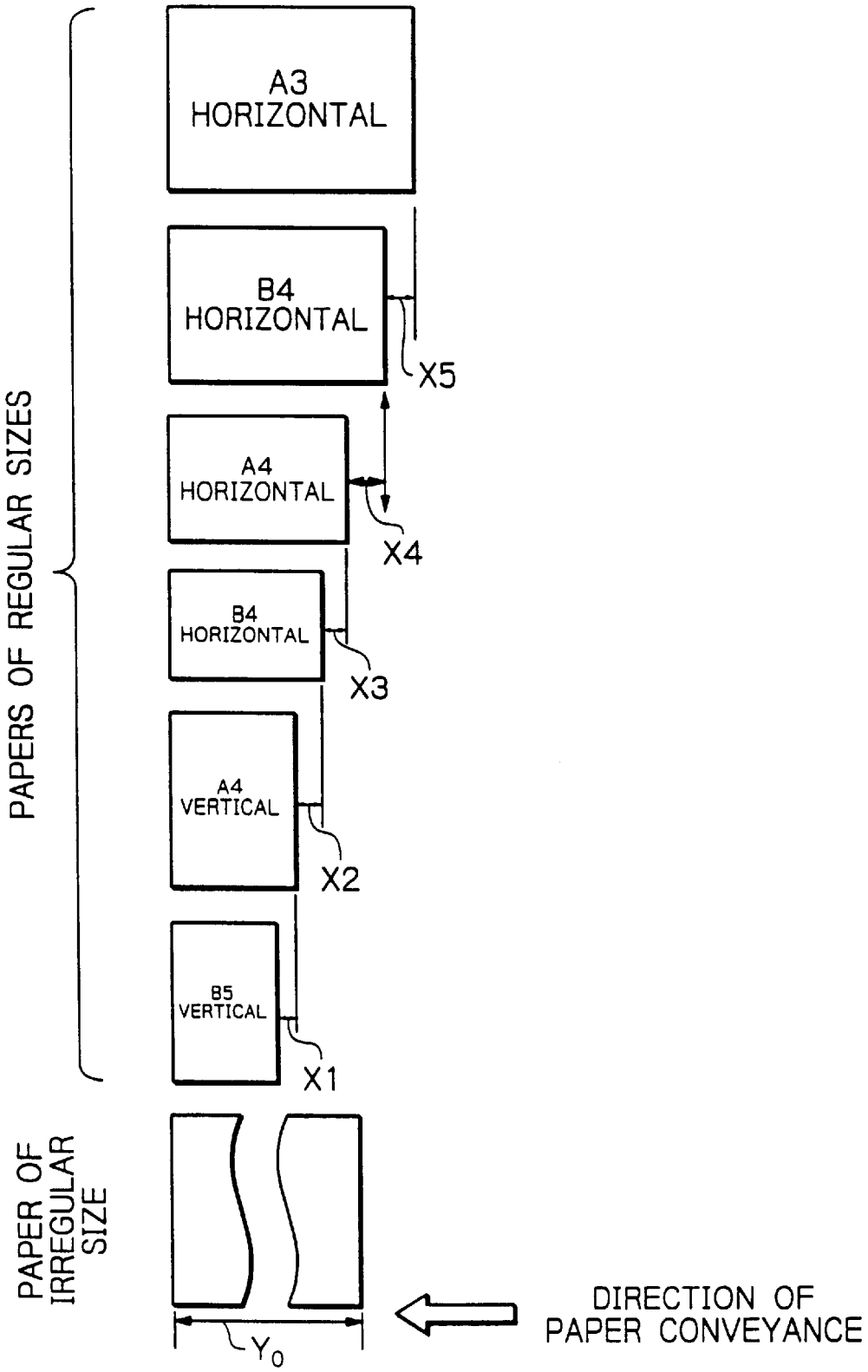
FIG. 13 is a view showing a relation Between papers of regular sizes and a paper of irregular size.

After the step G12, adequate one of the cam plates of the cam 40 matching with the paper size is selected (step G13). In this case, if the paper size is a regular size, one cam plate assigned to the regular size is selected via the stepped cam drive motor 52, as in the previously stated step E13. If the paper size is an irregular size, the control means 100 compares the dimension of the irregular papers 25 input on the numeral keys 131 and the lengths of papers of regular sizes and thereby selects an adequate cam plate. More specifically, as shown in FIG. 13 specifically, the control means 100 compares the dimension $Y_0$ of the irregular paper size and differences, as measured in the direction of paper conveyance D, between the papers 25 to which the cam plates 40*a*–40*e* of the cam 40 are respectively assigned. If the dimension $Y_0$ is smaller than a difference X1 between regular paper sizes, the cam plate 40*e* is selected. If the dimension $Y_0$ is smaller than a difference X2, the cam plate 40*d* is selected. If the dimension $Y_0$ is smaller than a difference X3, the cam plate 40*c* is selected. If the dimension $Y_0$ is smaller than a difference X4, the cam plate 40*b* is selected. Further, if the dimension $Y_0$ is smaller than a difference X5, the cam plate 40*a* is selected. That is, the cam plate 40*a* is selected for all of the papers 25 of itcgular sizes longer than the lengthwise dimension of the paper 25 of size B4. The other cam plates are selectively used with the papers 25 of irregular sizes shorter than the above dimension.

After the step G13, the previously stated trial printing operation is executed in the same manner as in the steps E14–E16 (step G14). If the paper or trial printing 25 produced by the above step is acceptable, the operator inputs a desired number of actual printings on the numeral keys 131 and then presses the print start key 133. In response, a printing operation begins (step G15) and produces printings (step G16). This is the end of the control.

As stated above, when the operator selects the automatic magnification change mode and inputs a desired paper size, the control means 100 executes control such that the document image matches in size with the papers of desired size ever if the paper size is irregular one. If the document 28 and papers 25 are different in orientation, the control means 100 rotates the document image by 90°. Further, the master 14 is cut off at a length matching with the paper size. This, coupled with the fact that the cam plate of the cam 40 matching with the paper size is selected, makes it needless to replace the ink drum 4 in accordance with the master size or the paper size. The operator therefore does not have to care about the direction and size of the document 25 or those of the papers 25. It follows that the above program promotes easy and efficient operation, reduces defective printings, and obviates the wasteful consumption of stencil and ink. In addition, the fences of the paper discharge tray 60 are adequately located to insure neat stacking of the papers or printings 25. Particularly, this kind of control is adaptive even to the papers 25 of irregular sizes and thereby broadens the range of papers 25 with which the printer is operable.

The magnification change ratio designated control program of FIG. 10 is as follows. As shown, the operator lays the document 28 on the document feed tray 108 or the glass platen 101 (step H1), presses any one of the keys of the magnification change ratio inputting means 141, FIG. 6, for inputting a desired magnification change ratio (step H2), and presses the perforation start key 132. In response, the control means100 determines the size and orientation of the document 28 on the basis of the output of the document size sensor 117 or 118 (step H3). Subsequently, the control means 100 determines, based on the outputs of the paper size sensors 70, 125 and 126, the sizes and orientations of the papers 25 stacked on the paper feed trays 12A, 12B and 29 (step H4). When the perforation start key 132 is pressed, the control means 100 drives the document reading section 2 in order to cause it to read the document 28. The resulting image data signal output from the image reading section 2 is written to the image memory 154 via the image processing means 155.

In a step H5 following the step H4, the control means 100 determines whether or not the papers 25 identical with the document size changed in magnification are present. If the answer of the step H5 is YES, the control means 100 determines whether or not a plurality of identical paper sizes are available (step H6). If the answer of the step H6 is YES, the control means 100 automatically selects the papers 25 having a shorter perforating length (step H7). If the answer of the step H6 is NO, the control means 100 automatically selects the papers 25 of the same size as the document size changed in magnification (step H8). The steps H5, H6 and H7 constitute a saving operation for saving the stencil and ink.

After the steps H7 and H8, the control means 100 determines the orientation of the document 28 and that of the papers 25 (step H9). If the document 28 and papers 25 are identical in orientation (YES, step H9), the control means executes a master making operation in matching relation to the paper size (step H10). In this case, the control means 100 delivers the image data signal output from the image reading section 2 to the thermal head 22 via the image processing means 155 in accordance with the magnification change ratio input on the inputting means 141 without varying the order of reading of the signal out of the image memory 154. At the same time, the control means 100 drives the platen drive motor 24 for causing the master 14 to be selectively perforated while being conveyed. Consequently, the image to be formed in the stencil 14 is reduced in size if the paper size is smaller than the document size or is ;enlarged in size if the former is greater than the latter (see FIG. 20).

If the answer of the step H9 is NO, the document image is rotated by 90° and then formed in the stencil 14 (step H11). Specifically, the image data signal is read out of the image memory 154 in such an order that the image to be formed in the stencil 14 is rotated by 90° in, e.g., the counterclockwise direction. The resulting image data signal is fed to the thermal head 22 via the image processing means 155 in accordance with the magnification change ratio input on the inputting means 141. Consequently, the image to be formed in the stencil 14 corresponds to the paper size and is rotated counterclockwise by 90° to coincide in orientation with the papers 25.

After the step H10 or H11, the perforated stencil or master 14 is cut off at a preselected length which is the paper size selected plus α (step H12). After the step H12, the side fences 61 and 62 and end fence 63 on the paper discharge tray 30 are moved in accordance with the paper size selected (step H13). Subsequently, adequate one of the cam plates of the cam 40 matching with the paper size is selected (step H14). After the step H14, the previously stated trial printing operation is executed (step H15). If the paper or trial printing 25 produced by the above step is acceptable, the operator inputs a desired number of actual printings on the numeral keys 131 and then presses the print start key 133. In response, a printing operation begins (step H16) and produces printings (step H17). This is the end of the control. The steps H12–H17 are identical with the step E11 and consecutive steps of FIG. 7 and will not be described specifically in order to avoid redundancy.

If the answer of the step H5 is NO, the control means 100 urges the operator to change the magnification change ratio or the size of the existing papers 25 or to select any one of the other existing papers 25.

To change the magnification change ratio, the operator inputs a new magnification change ratio capable of confining the document image in the current paper size (step H2) and again presses the perforation start key 132.

On the other hand, to change the paper size, the operator should only replace the existing papers 25 of different size with papers 25 of the same size as the document size changed in magnification in the step H2. For example, when the operator replaces only the papers 25 stacked on the tray 29 with papers 25 of the same size as the document changed in magnification, the step H6 is transferred to the step H9 via the step H8. In the step H9, the control means 100 determines whether or not the orientation of the document 28 and that of the papers 25 are identical. If the answer of the step H9 is YES, the control means 100 executes the step H10. If the answer of the step H9 is NO, the control means 100 executes the step H11.

Further, to select any one of the existing papers 25 in the step H18, the operator presses the paper size key 139 in order to select one of the trays loaded with the papers 25 of desired size (step H20). In a step H21 following the step H20, a magnification change ratio matching with the size of the above papers 25 is set. Specifically, the control means 100 automatically sets, based on the table of FIG. 20, a magnification change ratio capable of confining the document image in the paper size selected. Subsequently, in the step H9, the control means 100 determines whether or not the orientation of the document 28 and that of the papers 25 selected in the step H20 are identical. If the answer of the step H9 is YES, the control means causes the image data signal to be fed from the image memory 154 to the thermal head 22 via the image processing means 155 in accordance with the magnification change ratio. As a result, the image document is formed in the stencil 14 in a size matching with the paper size.

If the answer of the above step H9 is NO, the control means 100 causes the image data signal to be delivered from the image memory 154 to the thermal head via the image processing means 155 in accordance with the magnification change ratio while varying the order of reading of the signal. As a result, the document image rotated by 90° is formed in the stencil in a size matching with the paper size.

As stated above, even when the operator inputs any desired magnification change ratio, the control means 100 executes control based on the table of FIG. 20 such that the resulting document size lies within the paper size selected. If the document 28 and papers 25 are different in orientation, the control means 100 rotates the document image by 90° before perforation. Further, the master 14 is cut off at a length matching with the paper size. This, coupled with the fact that the cam plate of the cam 40 matching with the paper size is selected, makes it needless to replace the ink drum 4 in accordance with the master size or the paper size. The operator therefore does not have to care about the direction and size of the document 25 or those of the papers 25. It follows that the above program promotes easy and efficient operation, reduces defective printings, and obviates the wasteful consumption of stencil and ink. In addition, the fences of the paper discharge tray 60 are adequately located to insure neat stacking of the papers or printings 25.

Figure 14:
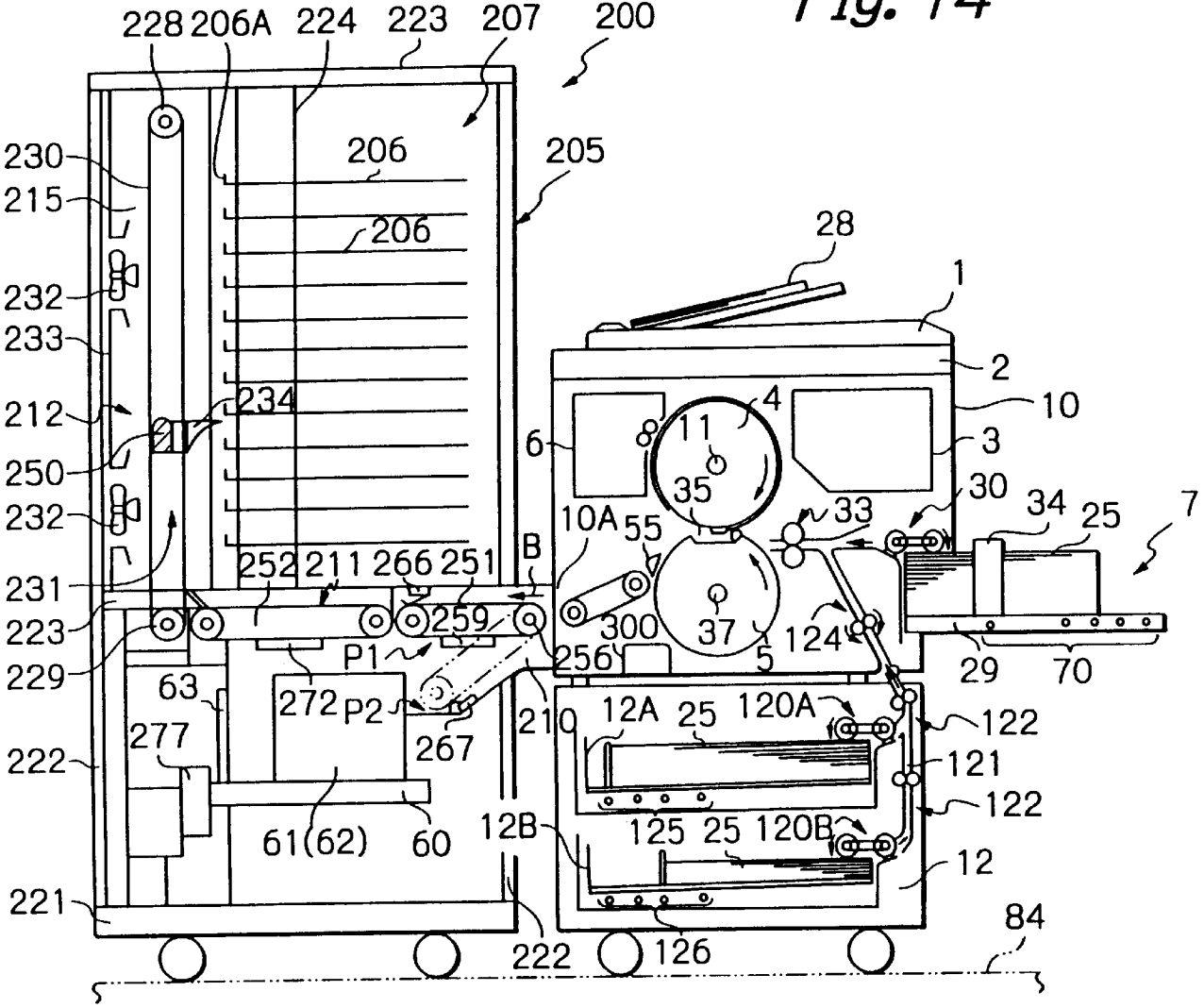
FIG. 14 is a front view showing an alternative embodiment of the present invention.

Reference will be made to FIG. 14 for describing an alternative embodiment of the present invention. This embodiment is identical with the previous embodiment except for the configuration of a paper discharge unit 200 and control over the paper discharge unit 200. In FIG. 14, the same structural elements as the elements shown in FIG. 1 are designated by identical reference numerals and will not be described in order to avoid redundancy.

As shown in FIG. 14, the paper discharge unit 200 is operatively connected to the printer body 10 and includes a rectangular, tower-like framework 205 freely movable on the floor 84. The framework 205 accommodates therein a bin unit 207, a paper discharge tray 60, distributing means 212 for distributing the papers 25 sequentially driven out of the printer body 10 to the bins 206, conveying means 211 including a sort path for guiding the papers 25 to the distributing means 212 and a non-sort path for guiding them to the paper discharge tray 60, and switching means 213 (see FIG. 17) for switching a path selector 251 to the sort path or the non-sort path. Control means 300 (see FIG. 18) controls the paper discharge unit 200 in accordance with the size and orientation of the papers 25 and whether or not a sort mode is selected.

The framework 205 includes a bottom frame 221, a plurality of vertical frames 222 connected to the bottom plate 221, and a plurality of horizontal frames 223 connecting the vertical frames 222. Outside panels 217 (see FIG. 15) are positioned at adequate positions adjoining the frames 222 and 223. The bin unit 207 having a plurality of bins 206 and the distributing means 212 are arranged in the upper portion of the framework 205.

The bin unit 207 includes a pair of vertical frames 224 extending between the top and bottom horizontal frames 223, and a plurality of bins 206 arranged one above the other between the vertical frames 224. The bins 206 each are formed with mount portions, not shown, at its right and left edges (front edge and rear edge as viewed in FIG. 14) and supported by the support portions, not shown, of the vertical frames 224 at the mount portions. The bins 206 have their inlet ends 206A aligned in the up-and-down direction. The distance between the inlet ends 206A of the bins 206 adjoining each other in the up-and-down direction is great enough for a preselected number of papers to be stacked on each bin 206. The portion of the framework 205 around the bins 206 is open, so that the operator simply standing by the paper discharge unit 200 can easily pick up the papers 25 from any one of the bins 206.

Figure 15:
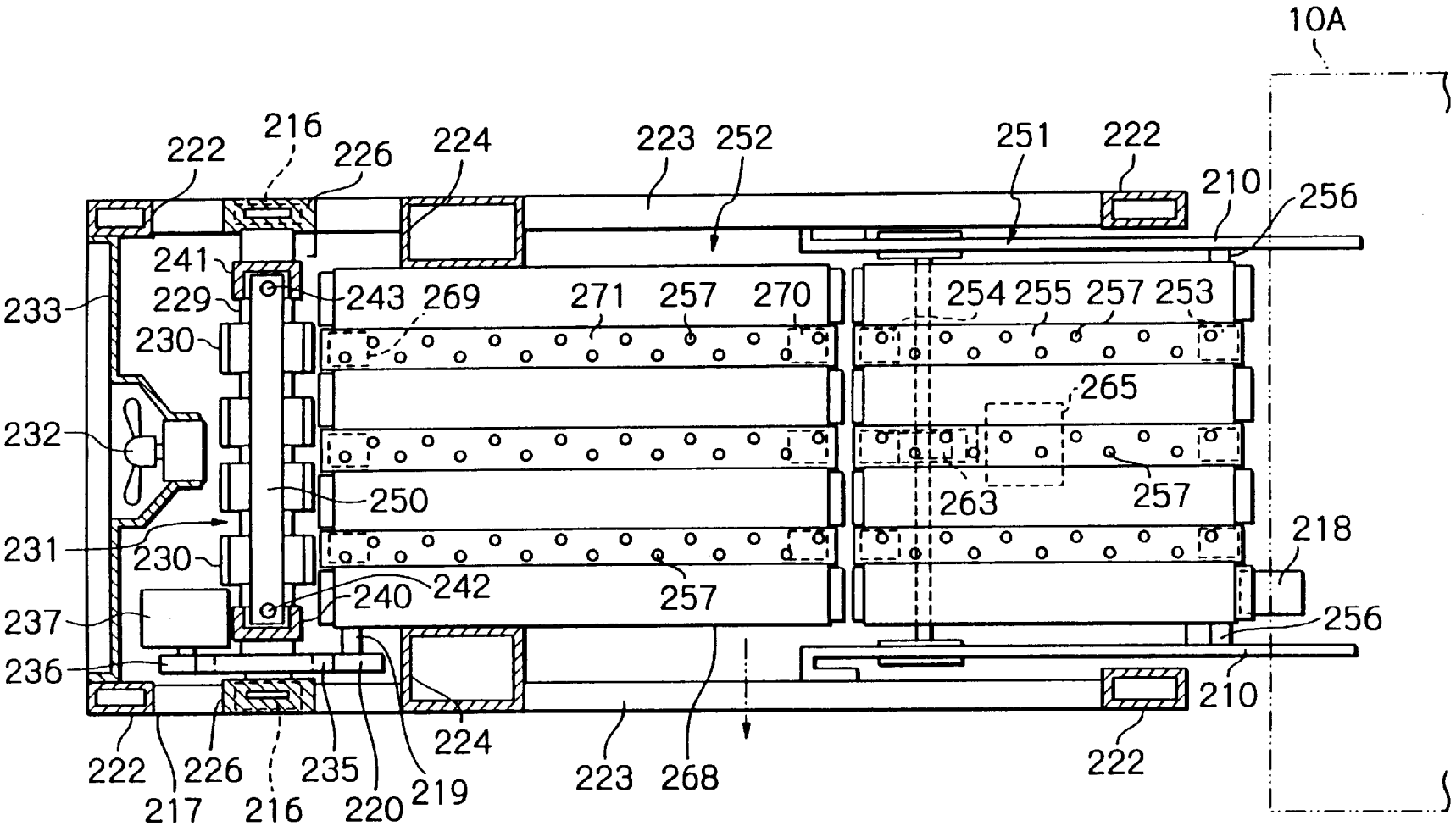
FIG. 15 is a plan view of conveying means included in the alternative embodiment and constituting a paper discharge section.

The distributing means 212 extends in parallel to the bin unit 207 and faces the inlet ends 206A of the bins 206. As shown in FIGS. 14 and 15, the distributing means 212 includes a pair of vertical frames 226 and a horizontal frame 227 connecting the vertical frames 226. An upper roller 228 and a lower roller 229 are respectively rotatably supported by the upper ends and lower ends of the vertical frames 226 via bearings (indicated by broken lines 216 in FIG. 15). A plurality of (four in the illustrative embodiment) endless belts 230 are passed over the rollers 228 and 229. An indexer 231 is arranged between the opposite runs of the belts 230 and steers each paper 25 conveyed vertically toward the upper surface of preselected one of the bins 206. An upper and a lower fan 232 face the belts 230 with the intermediary of a space 215 (see FIG. 14). An outside panel member 233 supports the fans 232 and isolates the space 215 and belts 230 from the outside.

Figure 16:
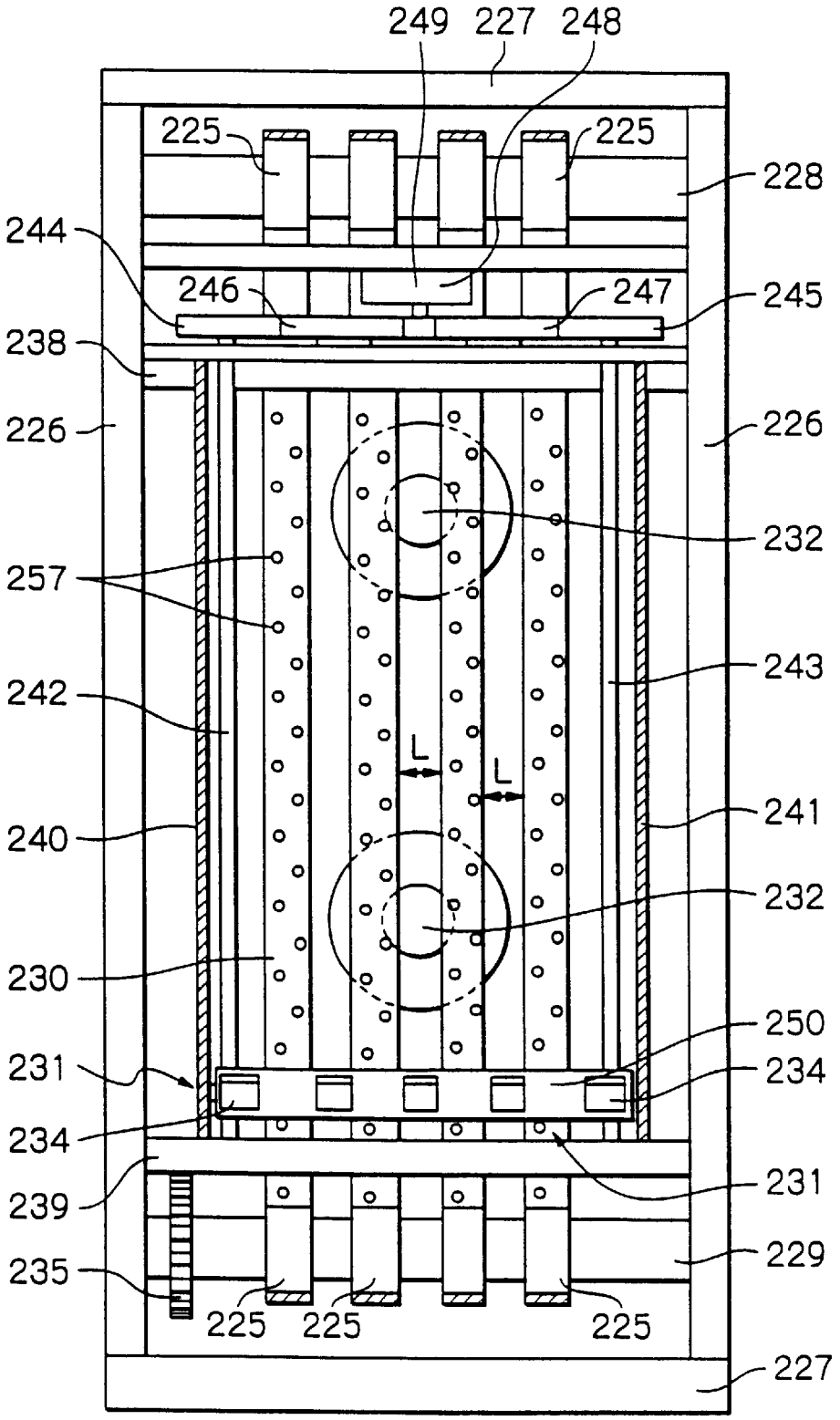
FIG. 16 is a front view of distributing means included in the alternative embodiment.

The belts 230 each are formed of synthetic resin or rubber by way of example. As shown in FIG. 16, the belts 230 are formed with a number of through holes 257. When the fans 232 are driven, they suck air through the holes 257 of the belts 230 so as to retain the paper 25 being conveyed on the belts 230. The upper roller or driven roller 228 and lower roller or drive roller 229 each is formed with four large diameter portions 225. The belts 230 each are passed over the large diameter portions 225 of the rollers 228 and 229 facing each other. Nearby belts 230 are spaced from each other by a gap L. The indexer 231 includes lugs 234 each being movably received in one of such gaps L. As shown in FIG. 15, a drive gear 235 is mounted on one end of the lower roller 229 and connected to a distribution drive motor 237 by a speed reduction gear train 236.

As shown in FIG. 16, the indexer 231 includes an upper and a lower horizontal frame 238 and 239 positioned in the vicinity of the upper and lower rollers 228 and 229, respectively. A pair of vertical frames 240 and 241 connect the horizontal frames 238 and 239 and are positioned in parallel to the vertical frames 226. A pair of feed shafts 242 extend in parallel to the verticle frames 240 and 241 and are journal led to the upper and lower horizontal frames 238 and 239. Driven gears 244 and 245 are respectively mounted on the upper ends of the feed shafts 242 and 243 above the upper horizontal frame 238. A drive gear 248 drives the driven gears 244 and 245 via intermediate gears 246 and 247, respectively. A sort drive motor 249 drives the drive gear 248. A movable frame 250 is held in threaded engagement with the feed shafts 242 and 243 at opposite sides thereof and movably received in grooves formed in the vertical frames 240 and 241 at opposite ends thereof. The lugs 234 protrude from the movable frame 250 into the gaps L between the belts 230.

While the paper discharge unit 200 is not in operation, the indexer 231 holds its lugs 234 at a reference position for sorting the paper 25 into the lowermost b in 206. In a sort mode, when a second sort signal for sorting the paper 25 into the second bin 206 from the bottom is input, the sort drive motor 249 is driven by one pitch to raise the lugs 234 to a second sort position. In this condition, the paper 25 is driven into the second bin 206 from the bottom by the lugs 234. In this manner, the papers 25 sequentially driven out of the printer body 10 are sequentially distributes to the bins 206 assigned to the expected number of papers. Thereafter, the sort driver motor 249 is reversed to return the lugs 234 to the reference position, completing the sorting operation with a single document 28.

Partitions, not shown, enclose spaces between the vertical frames 226 and the vertical frames 240 and 241 positioned inward of the frames 226, and the upper and lower spaces outside of the drive range of the belts 230. The partitions delimit a passage for air to be sucked by the fans 232 and thereby allow suction to act more positively on the paper 25 within the drive range of the belts 230.

As shown in FIG. 14, the conveying means 211 is located beneath the bin unit 207 and distributing means 212 for conveying the papers 25 to the distributing means 212 or the paper discharge tray or non-sort tray 60. The papers 25 driven out of the printer body 10 each are introduced into the conveying means 211 via an outlet 10A formed in the printer body 10. The conveying means 211 conveys the paper 25 in a direction of paper discharge B. The conveying means 211 includes the previously mentioned path selector 251 and a conveyor 252 connectable to the distributing means 212.

Figure 17:
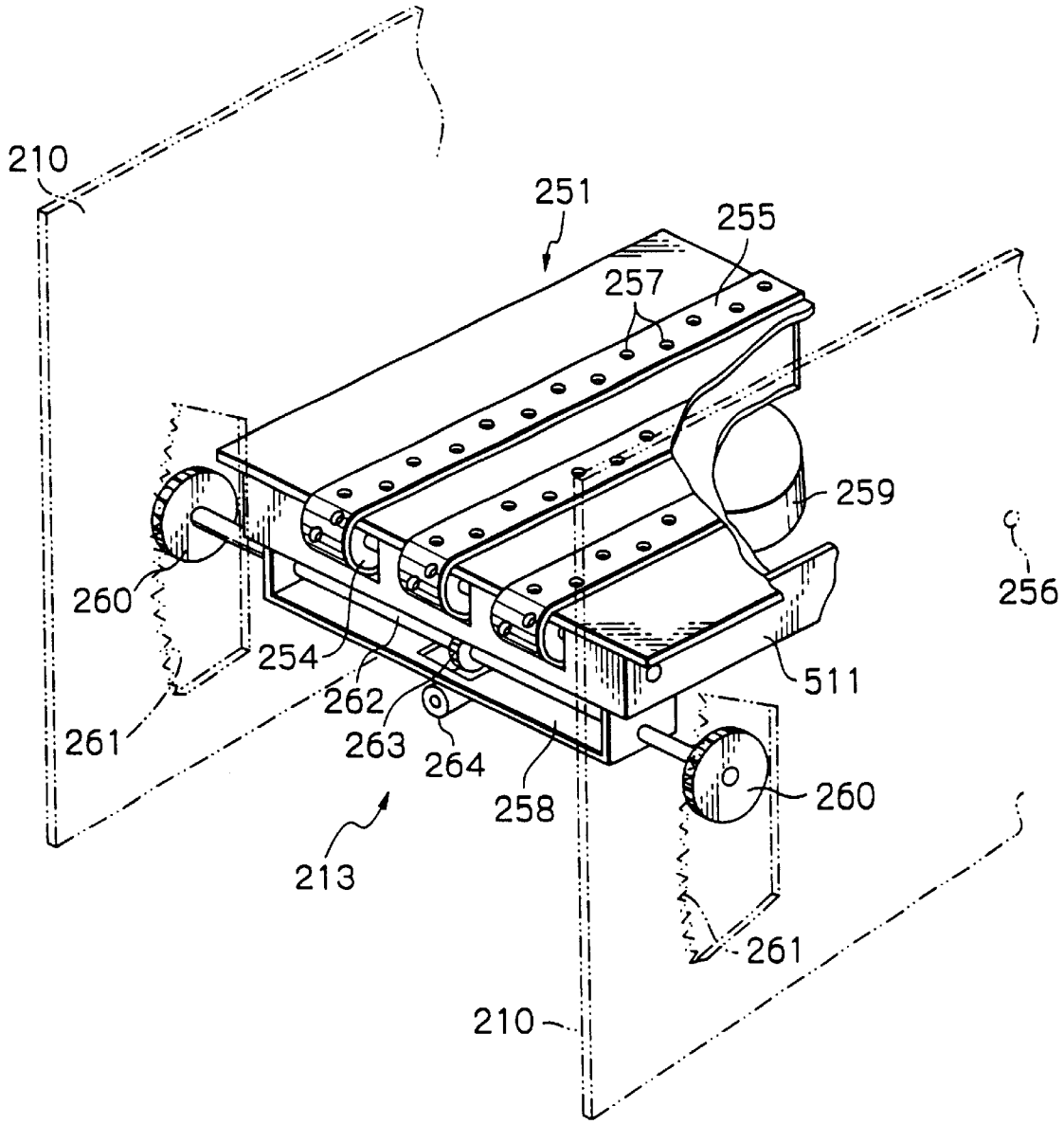
FIG. 17 is an enlarged oblique view showing essential part of switching drive means included in the alternative embodiment.

The path selector 251 is implemented as a horizontal conveyor. As shown in FIGS. 14, 15 and 17, the path selector 251 is mounted on opposite base plates 210 in such a manner as to be angularly movable up and down. The base plates 210 are connected to the vertical frames 222 and horizontal frames 223 of the framework 205. More specifically, the path selector 251 includes a flat box-like base 511 supported by the inner surfaces of the base plates 210. A drive pulley 253 and a driven pulley 254 are journalled to the inner surfaces of the base plates 210. A plurality of (three in the illustrative embodiment) endless belts 255 are passed over the pulleys 253 and 254 and partly exposed to the outside on the top of the base 511. A fan 259 is mounted on the bottom of the base 511 for retaining the paper 25 on the belts 255 by suction. A path selector drive motor 218 is drivably connected to the drive pulley 253 via a conventional drive transmission mechanism, e.g., a chain and sprocket mechanism not shown. In this configuration, the belts 255 are rotated counterclockwise, as viewed in FIG. 14, as needed.

The belts 255 are formed of synthetic resin or rubber by way of example and formed with a number of through holes 257. When the fan 259 is driven, it suck air out of the base 511 through the holes 257 of the belts 255 so as to retain the paper 25 being conveyed on the belts 255.

Pivot pins 256 respectively protrude horizontally from the right and left sidewalls of the base 511 at the paper inlet side. The pivot pins 256 are coaxial with the drive pulley 253 (see FIG. 15) and rotatably supported by the base plates 210. In this condition, the paper inlet side of the belts 255 and base 511 constantly faces the paper outlet 10A of the printer body 10. The paper outlet side of the base 511 is angularly movable up and down about the pivot pins 256. The switching means 213 mentioned earlier (see FIG. 17) is mounted on the bottom wall, not shown, of the base 511 at the paper outlet side.

The switching means 213 causes the path selector 251 to move up and down about the pivot pins 256. In the sort mode, the switching means 213 holds the path selector 251 at a sort position P1 (indicated by a solid line in FIG. 14) facing the conveyor 252, thereby forming the sort path mentioned earlier. In a non-sort mode, the switching means 213 holds the path selector 251 in a non-sort position P2 (indicated by a dash-and-dots line in FIG. 14) facing the paper discharge tray 60, thereby forming the non-sort path.

Specifically, the switching means 213 includes a bracket 258 protruding from the underside of the base 511. A pair of pinions 260 are mounted on opposite ends of a shaft 262 rotatably supported by the bracket 258. Racks 261 each are formed in one of the base plates 210 and held in mesh with one of the pinions 260. A worm wheel 263 is mounted on the intermediate portion of the shaft 262 and held in mesh with a worm 264. A switching drive motor 265 (see FIG. 15) drives the worm 264. The racks 261 each have a sectorial shape whose center is defined by the axis of the aligned pivot pins 256. To selectively move the path selector 251 to the sort position P1 or the non-sort position P2, a sort signal is sent from the control panel 130 shown in FIG. 18 to the control means 300. In response, the control means 300 sends a control signal to the switching drive motor 265 connected to the worm 264. As shown in FIG. 14, a first sensor 266 and a second sensor 267 are located in the range over which the path selector 251 is movable between the sort position P1 and the non-sort position P2. The first sensor 266 is responsive to the sort position P1 of the path selector 251 where the outlet end of the selector 251 is communicated to the conveyor 252. The second sensor 267 is responsive to the non-sort position P2 of the path selector 251 where the outlet end of the selector 251 is communicated to the paper discharge tray 60. The motor 265 selectively drives the pinions 260 in the forward or the reverse direction in accordance with the outputs of the sensors 266 and 267, thereby switching the path selector 251 to either one of the two positions P1 and P2.

As shown in FIG. 15, the conveyor 252 connectable to the distributing means 212 includes a flat box-like base 268, a pair of pulleys 269 and 270 rotatably supported within the base 268, a plurality of (three in the illustrative embodiment) endless belts 271 passed over the pulleys 269 and 270 and partly exposed to the outside on the top of the base 268, and a suction fan 272 mounted on the bottom of the base 268 for retaining the paper 25 on the belts 271 by suction. A gear 220 is mounted on a shaft 219 supporting the pulley 269 and is held in mesh with the drive gear 235. The base 268 is mounted substantially horizontally on the vertical frames 224. When the path selector 251 is held in the sort position P1, the base 268 receives the paper 25 from the paper selector 251 and transfers the paper 25 to the lower end of the distributing means 212 by steering it with pieces 268*a* adjoining the distributing means 212. The belts 271 are also formed of synthetic resin or rubber by way of example and formed with a number of through holes 257. The suction fan 272 retains the paper 25 on the belts 271 by sucking air out of the base 268 through the holes 257.

The paper discharge tray 60 includes the side fences 61 and 62 and end fence 63 as well as mechanisms for driving them, as in the previous embodiment. The paper discharge tray 60 will not be described specifically because it also has the configuration described with reference to FIG. 5. The paper discharge tray 60 is supported by a vertical support frame 277 positioned in the lower portion of the framework 205.

As shown in FIG. 18, the control means 300 includes a CPU 301, a ROM 302, a RAM 303, an image memory 304 for storing image data representative of a document image read by the document reading section 2, and image processing means 305. The image memory 304, document reading means 2 and thermal head 22 are connected to the image processing means 305.

The first and second sensors 266 and 267 mentioned previously are connected to the input side of the CPU 301 by wirings, not shown, together with the various sensors included in the previous embodiment. The path selector drive motor 218, distribution drive motor 237, sort drive motor 249 and switching drive motor 265, as well as the motors of the previous embodiment, each are connected to the output side of the CPU 301 via a respective driver not shown. The ROM 302 stores motor rotation angle data representative of the reference positions of the fences of the paper discharge tray 60, the magnification change table of FIG. 20 listing data representative of a relation between the magnification and the rotation dependent on the sizes and orientations of the documents 28 and papers 25. Further, the ROM 302 stores the map for determining the sizes and orientations of the documents 28 and papers 25 on the bas is of the outputs of the document size sensing means 117 and 118 and the outputs of the paper size sensors 70, 125 and 126. In response to the outputs of the paper size sensors 70, 125 and 126, the control means 100 searches for the tray 12A, 12B or 29 loaded with the papers 25 of desired size. In addition, the ROM 302 sores a paper selection control program shown in FIGS. 19A–19C and used to drive the various motors of the paper discharge unit 200 in accordance with the size of the papers 25 or the sort mode selected. In the illustrative embodiment, the control panel 130 additionally includes a sort key 280 for allowing the operator to select the sort mode. When the sort key 280 is pressed, it sends a signal indicative of the sort mode to the CPU 301.

Figures 1, 19A:
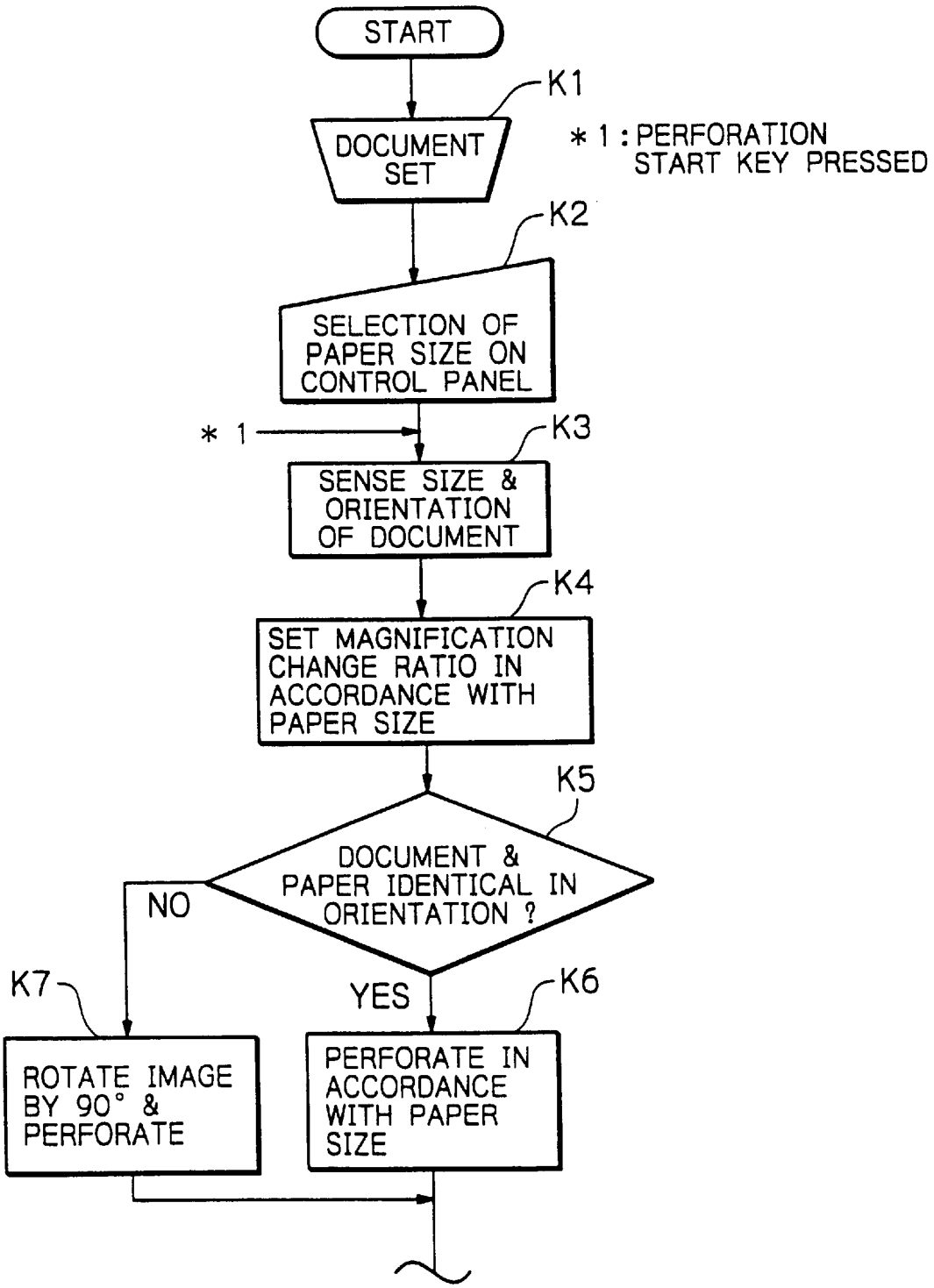
FIGS. 19A–19C are flowcharts representative of a paper selection control program to be executed by the control means of FIG. 18.
Figures 2, 19A:
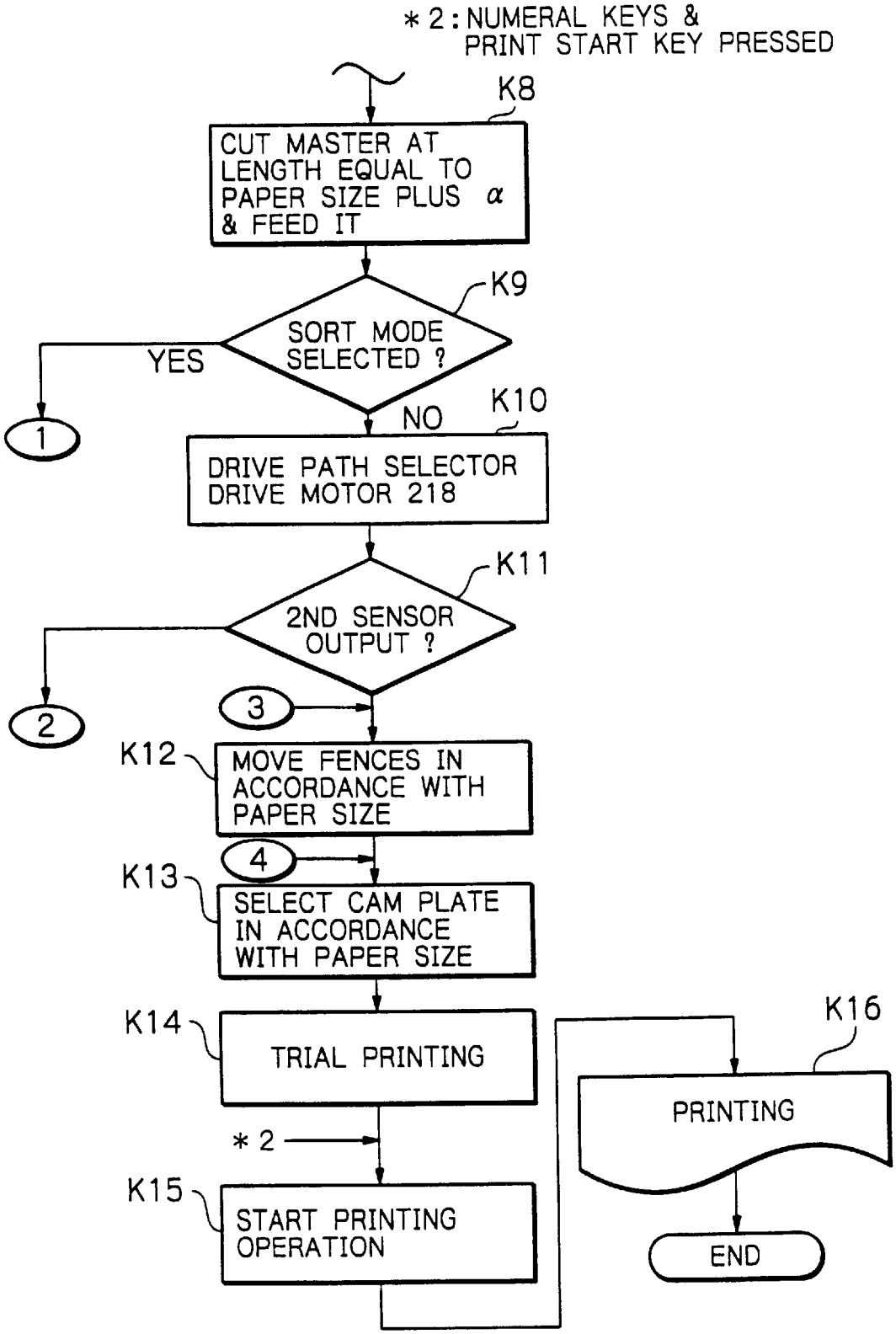

A specific operation of the illustrative embodiment will be described with reference to FIGS. 19A–19C. In FIG. 19A, steps K12–K16 are the same as in the paper selector control program of FIG. 8 and will not be described specifically in order to avoid redundancy. The following description will concentrate on control steps relating to the paper discharge unit 200. As shown, the operator sets the document 28 (step K1), selects a desired paper size or paper feed tray on the paper size key 139 (step K2), and then presses the perforation start key 132. In response, the control means 300 determines the size and orientation of the document 28 (step K3), reads the document 28, and writes the resulting image data signal in the image memory 304 via the image processing means 305. If the operator presses the sort key 280 before the perforation start key 132, the control means 300 sets up the sort mode.

The control means 100 automatically sets, based on the table of FIG. 20, a magnification change ratio capable of confining the document image in the paper size selected (step K4). Subsequently, the control means 100 determines whether or not the orientation of the document 28 and that of the papers 25 are identical (step K5). If the answer of the step K5 is YES, the control means 100 executes a master making operation in matching relation to the paper size (step K6). If the answer of the step K5 is NO, the control means 100 rotates the document image by 90° before the master making operation (step K7). Thereafter, the control means 300 causes the master 14 to be cut off at the length equal to the paper size plus $\alpha$ and causes the mater 14 to be wrapped around the ink drum 4 (step K8).

In a step K9 following the step K8, the control means 300 determines whether or not the sort mode is selected. If the answer of the step K9 is NO, the control means 300 drives the path selector drive motor 218 (step K10) and then determines, based on the output of the second sensor 267, whether or not the path selector 251 is held in the non-sort mode P2 (step K11). If the answer of the step K11 is YES, the control means 300 executes the next step K12, determining that the path selector 251 is located at the non-sort mode P2. If the answer of the step K11 is NO, the control means 300 executes a step K17 shown in FIG. 19B, determining that the path selector 251 is not located at the non-sort position kP2. In the step K17, the control means 300 drives the switching drive motor 265 in order to bring the path selector 251 to the non-sort position P2 facing the paper discharge tray 60, as shown in FIG. 14. Subsequently, the control means stops, based on the output of the second sensor 267 responsive to the position P2, the rotation of the motor 265 (step K18) and then executes a step K12 shown in FIG. 19A.

In the step K12, the control means 300 moves the fences of the paper discharge tray 60 in accordance with the paper size selected. Then, the control means 300 selects one of the cam plates of the cam 40 matching with the paper size (step K13) and executes a trial printing operation (step K14). The paper or trial printing 25 output by this operation is conveyed from the paper outlet 10A to the paper discharge tray 60 by the belts 255 of the path selector 251. After the trial printing operation, the operator inputs a desired number of printings on the numeral keys 131 and then presses the print start key 133. In response, the control means 300 starts a printing operation (step K15) and executes printing (step K16). This is the end of the control program. The papers or printings 25 are sequentially driven out via the paper outlet 10A of the printer body 10 and stacked on the paper discharge tray 60 via the path selector 251.

Assume that the operator selects the sort mode (YES, step K9). Then, the controller 300 drives the path selector drive motor 218, distribution drive motor 237 and sort drive motor 249 (step K20, FIG. 19C). Subsequently, the control means 300 determines, based on the output of the first sensor 266, whether or not the path selector 251 is held in the sort position P1 (step K21). If the answer of the step K21 is NO, the control means drives the switching drive motor 265 (step K22), determining that the path selector 251 is not located at the sort position P1. As a result, the path selector 251 is brought to the sort position P1 aligning with the conveyor 252. When the free end of the path selector 251 contacts the first sensor 266, the sensor 266 outputs a sense signal (YES, step K21). In response, the control means 300 stops rotating the motor 265 (step K23) so as to locate the path selector 251 at the sort position P1. Thereafter, the control means 100 selects one of the cam plates of the cam 40 (step K13, FIG. 19A) and then executes a trial printing operation (step K14).

The paper or trial printing 25 output by the above operation is conveyed from the paper outlet 10A to the distributing means 212 by the belts 255 via the conveyor 252. When the paper 25 is conveyed upward by the distributing means 212, the indexer 231 steers the paper 25 toward the upper surface of designated one of the bins 206 with its lugs 234. At this instant, the control means drives the suction fans 259, 272 and 232 as well as the belts 255, 271 and 230, thereby guaranteeing the sure conveyance of the papers 25.

After the trial printing, the operator inputs a desired number of printings and a desired number of copies (sets) on the numeral keys 131 and then presses the print start key 133. In response, the control means starts a printing operation (step K15), executes printing (step K16), and then ends the control program. When the sort drive motor 249 is driven, it causes the indexer 231 to sequentially move its lugs 234 upward from the reference position facing the first bin 206 by one pitch at a time. The lugs 234 sequentially steer the consecutive papers 25 into the bins 206 while moving upward pitch by pitch.

As stated above, even when the operator selects any desired paper size, the control means 300 executes control based on the table of FIG. 20 such that the resulting document size lies within the paper size selected. If the document 28 and papers 25 are different in orientation, the control means 100 rotates the document image by 90° before perforation. Further, the master 14 is cut off at a length matching with the paper size. This, coupled with the fact that the cam plate of the cam 40 matching with the paper size is selected, makes it needless to replace the ink drum 4 in accordance with the master size or the paper size. The operator therefore does not have to care about the direction and size of the document 25 or those of the papers 25. It follows that the above program promotes easy and efficient operation, reduces defective printings, and obviates the wasteful consumption of stencil and ink. This is also true when the operator selects the sort mode which is expected to output a great amount of printings. Particularly, the fences of the paper discharge tray 60 are adequately located to insure neat stacking of the papers or printings 25.

Figure 19B:
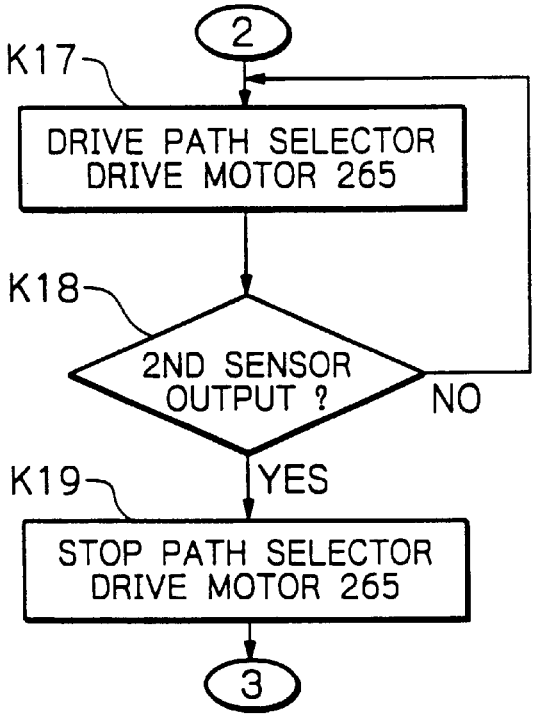
Figure 19C:
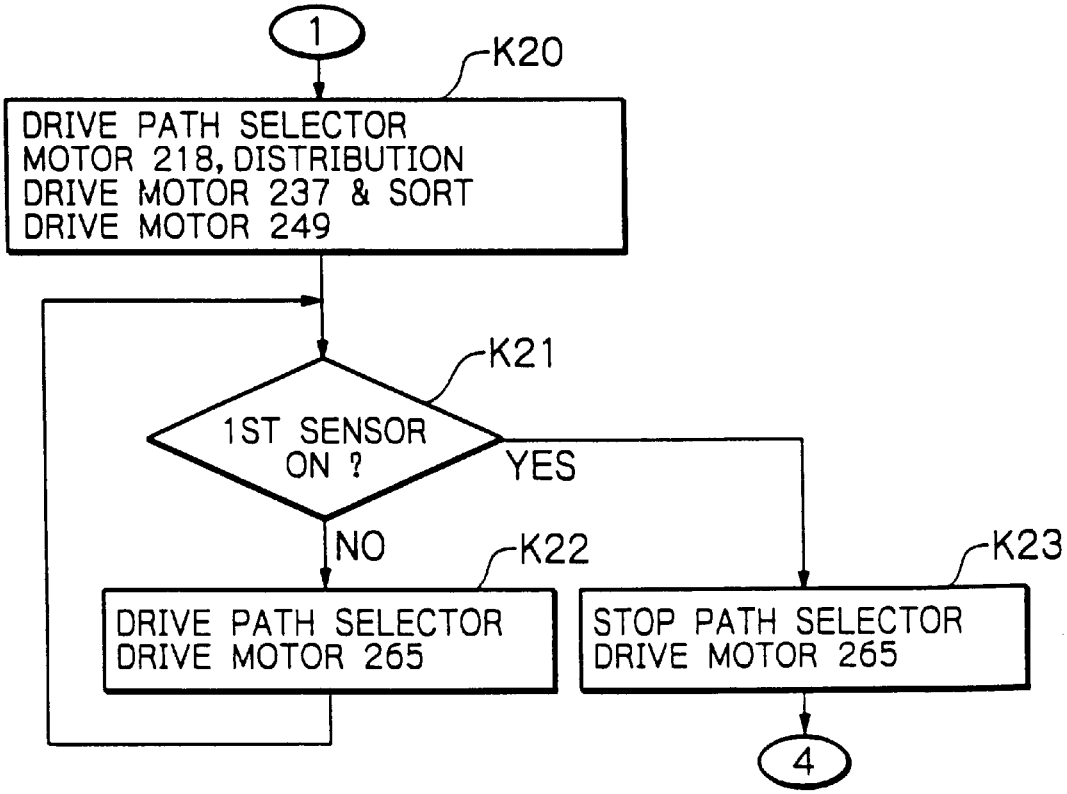

Of course, the control program of the above embodiment, i.e., the steps shown in FIGS. 19A–19C may be added to the control programs of FIGS. 7–10 and stored in the ROM 302 for controlling the paper discharge unit 200. This also makes it needless for the operator, desiring a great amount of printings, to give consideration to the magnification change ratio of the document size or the orientations and sizes of the document 28 and papers 25 because the control means 300 adequately controls the various motors of the paper discharge unit 200. The papers or printings 25 can therefore be efficiently sorted by easy operation and are free from defects.

While the illustrative embodiments shown and described deal with specific paper sizes ranging from size A3 to size B5 and specific orientations thereof, they are, of course, capable of handling other paper sizes including size A5, postcard size and name card size. This can be done only if additional paper size sensors are used or if the cams 40 and 47 each are provided with additional cam plates or cam portions or replaced with another suitable cam.

In the illustrative embodiments, the pressure cancel cam 40 is used to limit the range over which the press drum 5 contacts the ink drum 4. Alternatively, an arrangement may be made such that the press drum 5 constantly biased toward the ink drum 4 is selectively released from the ink drum 4 and has its contact time controlled steplessly by the control means 100 or 300. This alternative scheme does not need the cam 40 or the drive transmission mechanism associated therewith, the arms 43, the stepped cam 47 or the driveline including the stepped cam drive motor 52 and can produce a master having an adequate length without regard to the paper size.

The paper discharge unit 200 shown in FIG. 14 includes the paper discharge tray or non-sort tray 60 and bins 206. If desired, the bins 206 may also be implemented as non-sort trays similar to the tray 60 and arranged one above the other. In such a case, the sort drive motor 249 will also be controlled to adjust the positions of the lugs 234 of the indexer 231 in accordance with the size and orientation of the papers 25. The trays replacing the bins 206 each should preferably be provided with the end tray 63 at a position adjoining the printer body 10.

In summary, it will be seen that the present invention provides a stencil printer having various unprecedented advantages, as enumerated below.

(1) When a document and papers are different in orientation, master making means is control led on the basis of the orientation of the papers and therefore forms a document image in a stencil in accordance with the orientation of the papers. This, coupled with side fences and an end fence positioned in accordance with the paper size, allows desirable printings to be produced and neatly stacked without the operator caring about the orientations of the document and papers or the positions of the above fences.

(2) When a document and papers are different in size, the master making means is controlled on the basis of the size of the papers and therefore forms a document image in a stencil after automatically changing the magnification in accordance with the paper size. This, coupled with side fences and an end fence positioned in accordance with the paper size, also achieves the above advantage (1).

(3) When a document and papers are different in orientation and size, the master making means is controlled on the basis of the orientation and size of the papers and therefore forms a document image in a stencil in accordance with the orientation of the papers after automatically changing the magnification in accordance with the paper size. This, coupled with side fences and an end fence positioned in accordance with the paper size, also achieves the above advantage (1).

(4) When a document and papers are different in orientation, the order in which an image data signal is read out of an image memory is so controlled as to rotate a document image by 90° before the perforation of a stencil. An image can therefore be printed on the papers in accordance with the orientation of the papers, rendering the resulting printings more desirable.

(5) At the time of a saving operation, a paper feed tray loaded with papers having a minimum length in the direction of paper transport is selected, thereby reducing the perforation range of a stencil in the above direction. The printer can therefore obviate the wasteful consumption of the stencil and ink by use of a single ink drum while also achieving the above advantage (1).

(6) Even when the document size is changed in magnification, the above tray loaded with papers having a minimum length in the direction of paper transport is selected. This is successful to reduce the perforation range of the stencil while adjusting the orientation and size of the document image in accordance with the orientation and size of the papers, and also achieves the above advantage (1) and (5).

(7) Even when the paper size to be used is changed, the stencil is cut off at a length corresponding to the paper size while contact area varying means is operated in accordance with the cut length of the stencil or master. Therefore, even when the size and orientation of the papers are changed, the printer makes it needless to replace the ink drum while successfully adjusting the orientation and size of the document image in accordance with the orientation and size of the papers. This also achieves the advantages (1) and (5).

(8) The papers are selectively conveyed to bins or a paper discharge tray via a movable path selector with the document image being adjusted in size and orientation in matching relation to the papers. This also achieves the advantages (1) and (5).

(9) When the document is set on a document feed tray, feeding means conveys it to a document reading section. It follows that the entire sequence beginning with document feed and ending with paper stacking on a paper discharge tray can be automatically executed.

Various modifications will become possible for those skilled in the art after receiving the teachings of the present disclosure without departing from the scope thereof.

What is claimed is:

1. A stencil printer comprising:

an ink drum for wrapping a master around an outer periphery thereof;

master making means for making the master;

a paper discharging section including a paper discharge tray having a pair of side fences spaced from each other in a widthwise direction of a paper and movable in said widthwise direction and an end fence selectively movable forward or backward in a direction of paper discharge;

side fence moving means for moving said pair of side fences in the widthwise direction;

end fence moving means for moving said end fence in the direction of paper discharge;

document size sensing means for sensing a size of a document;

paper size sensing means for sensing a size of the paper; and control means for controlling said master making means, said side fence moving means and said end fence moving means;

said control means determining, based on information output from said document size sensing means and said paper size sensing means, an orientation of the document, an orientation of the paper and a size of said paper and controlling, if said document and said paper are different in orientation, said master making means on the basis of the orientation of said paper to thereby orient a document image to be formed in the master in accordance with the orientation of said paper, and controlling said side fence moving means and said end fence moving means for locating each of said pair of side fences and said end fence at a particular position matching with the size of said paper.

2. A stencil printer as claimed in claim 1, further comprising an image memory for storing an image data signal representative of the document image, said control means rotating, if the document and the paper are different in orientation, the document image to be formed in the master by 90° by controlling an order in which said image signal is read out of said image memory.

3. A stencil printer as claimed in claim 2, further comprising a plurality of trays each being loaded with a stack of papers, said control means executing a saving operation for selecting, based on the information output from said paper size sensing means, one of said plurality of trays whose papers have a minimum length in a direction of paper conveyance.

4. A stencil printer as claimed in claim 3, wherein said control means executes said saving operation when a plurality of papers with a same size as the document are sensed.

5. A stencil printer as claimed in claim 3, further comprising magnification change ratio inputting means for inputting a magnification change ratio of the size of the document, said control means executing said saving operation when a plurality of papers with a size corresponding to the magnification change ratio input on said magnification change ratio inputting means are sensed.

6. A stencil printer as claimed in claim 1, further comprising a plurality of trays each being loaded with a stack of papers, said control means executing a saving operation for selecting, based on the information output from said paper size sensing means, one of said plurality of trays whose papers have a minimum length in a direction of paper conveyance.

7. A stencil printer as claimed in claim 6, wherein said control means executes said saving operation when a plurality of papers with a same size as the document are sensed.

8. A stencil printer as claimed in claim 6, further comprising magnification change ratio inputting means for inputting a magnification change ratio of the size of the document, said control means executing said saving operation when a plurality of papers with a size corresponding to the magnification change ratio input on said magnification change ratio inputting means are sensed.

9. A stencil printer as claimed in claim 1, further comprising:

a pressing member selectively movable into or out of contact with the outer periphery of said ink drum;

contact area varying means for varying a range over which said pressing member contacts the outer periphery of said ink drum; and cutting means for cutting off the master;

said control means controlling said cutting means such that the master is cut off at a length corresponding to the size of the paper, and controlling an operation of said contact area varying means in accordance with the length of said master.

10. A stencil printer as claimed in claim 1, wherein said paper discharging section comprises:

a plurality of bins supported in a framework one above the other;

distributing means for distributing the paper to a designated one of said plurality of bins;

conveying means for selectively forming, in accordance with a support position of a path selector, a sort path for guiding the paper to said distributing means and a non-sort path for guiding said paper to said paper discharge tray; and switching drive means for switching the support position of said path selector in such a manner as to form either one of said sort path and said non-sort path;

said control means controlling an operation of said distributing means and controlling an operation of said switching drive means such that said path selector is selectively located at a support position for forming said sort path or a support position for forming said non-sort path.

11. A stencil printer as claimed in claim 1, further comprising an ADF (Automatic Document Feeder) including a document feed tray to be loaded with the document and feeding means for feeding said document from said document feed tray to a document reading section.

12. A stencil printer comprising:

an ink drum for wrapping a master around an outer periphery thereof;

master making means for making the master;

a paper discharging section including a paper discharge tray having a pair of side fences spaced from each other in a widthwise direction of a paper and movable in said widthwise direction and an end fence selectively movable forward or backward in a direction of paper discharge;

side fence moving means for moving said pair of side fences in the widthwise direction;

end fence moving means for moving said end fence in the direction of paper discharge;

document size sensing means for sensing a size of a document;

paper size sensing means for sensing a size of the paper; and control means for controlling said master making means, said side fence moving means and said end fence moving means;

said control means determining, based on information output from said document size sensing means and said paper size sensing means, a size of the document and a size of the paper and controlling, if said document and said paper are different in size, said master making means on the basis of the size of said paper to thereby automatically change a magnification of a document image to be formed in the master in accordance with the size of said paper, and controlling said side fence moving means and said end fence moving means for locating each of said pair of side fences and said end fence at a particular position matching with the size of said paper.

13. A stencil printer as claimed in claim 12, further comprising a plurality of trays each being loaded with a stack of papers, said control means executing a saving operation for selecting, based on the information output from said paper size sensing means, one of said plurality of trays whose papers have a minimum length in the direction of paper transport.

14. A stencil printer as claimed in claim 13, wherein said control means executes said saving operation when a plurality of papers with a same size as the document are sensed.

15. A stencil printer as claimed in claim 14, further comprising magnification change ratio inputting means for inputting a magnification change ratio of the size of the document, said control means executing said saving operation when a plurality of papers with a size corresponding to the magnification change ratio input on said magnification change ratio inputting means are sensed.

16. A stencil printer as claimed in claim 12, further comprising:

a pressing member selectively movable into or out of contact with the outer periphery of said ink drum;

contact area varying means for varying a range over which said pressing member contacts the outer periphery of said ink drum; and cutting means for cutting off the master;

said control means controlling said cutting means such that the master is cut off at a length corresponding to the size of the paper, and controlling an operation of said contact area varying means in accordance with the length of said master.

17. A stencil printer as claimed in claim 12, wherein said paper discharging section comprises:

a plurality of bins supported in a framework one above the other;

distributing means for distributing the paper to a designated one of said plurality of bins;

conveying means for selectively forming, in accordance with a support position of a path selector, a sort path for guiding the paper to said distributing means and a non-sort path for guiding said paper to said paper discharge tray; and switching drive means for switching the support position of said path selector in such a manner as to form either one of said sort path and said non-sort path;

said control means controlling an operation of said distributing means and controlling an operation of said switching drive means such that said path selector is selectively located at a support position for forming said sort path or a support position for forming said non-sort path.

18. A stencil printer as claimed in claim 12, further comprising an ADF (Automatic Document Feeder) including a document feed tray to be loaded with the document and feeding means for feeding said document from said document feed tray to a document reading section.

19. A stencil printer comprising:

an ink drum for wrapping a master around an outer periphery thereof;

master making means for making the master;

a paper discharging section including a paper discharge tray having a pair of side fences spaced from each other in a widthwise direction of a paper and movable in said widthwise direction and an end fence selectively movable for ward or backward in a direction of paper discharge;

side fence moving means for moving said pair of side fences in the widthwise direction;

end fence moving means for moving said end fence in the direction of paper discharge;

document size sensing means for sensing a size of a document;

paper size sensing means for sensing a size of the paper; and control means for controlling said master making means, said side fence moving means and said end fence moving means;

said control means determining, based on information output from said document size sensing means and said paper size sensing means, an orientation and a size of the document and an orientation and a size of the paper and controlling, if said document and said paper are different in orientation and size, said master making means on the basis of the orientation and the size of said paper to thereby form the document image in the master in accordance with the orientation of said paper and automatically change a magnification of said document image in accordance with the size of said paper, and controlling said side fence moving means and said end fence moving means for locating each of said pair of side fences and said end fence at a particular position matching with the size of said paper.

20. A stencil printer as claimed in claim 19, further comprising an image memory for storing an image data signal representative of the document image, said control means rotating, if the document and the paper are different in orientation, the document image to be formed in the master by 90° by controlling an order in which said image signal is read out of said image memory.

21. A stencil printer as claimed in claim 20, further comprising a plurality of trays each being loaded with a stack of papers, said control means executing a saving operation for selecting, based on the information output from said paper size sensing means, one of said plurality of trays whose papers have a minimum length in the direction of paper transport.

22. A stencil printer as claimed in claim 21, wherein said control means executes said saving operation when a plurality of papers with a same size as the document are sensed.

23. A stencil printer as claimed in claim 21, further comprising magnification change ratio inputting means for inputting a magnification change ratio of the size of the document, said control means executing said saving operation when a plurality of papers with a size corresponding to the magnification change ratio input on said magnification change ratio inputting means are sensed.

24. A stencil printer as claimed in claim 19, further comprising a plurality of trays each being loaded with a stack of papers, said control means executing a saving operation for selecting, based on the information output from said paper size sensing means, one of said plurality of trays whose papers have a minimum length in the direction of paper transport.

25. A stencil printer as claimed in claim 24, wherein said control means executes said saving operation when a plurality of papers with a same size as the document are sensed.

26. A stencil printer as claimed in claim 24, further comprising magnification change ratio inputting means for inputting a magnification change ratio of the size of the document, said control means executing said saving operation when a plurality of papers with a size corresponding to the magnification change ratio input on said magnification change ratio inputting means are sensed.

27. A stencil printer as claimed in claim 19, further comprising:

a pressing member selectively movable into or out of contact with the outer periphery of said ink drum;

contact area varying means for varying a range over which said pressing member contacts the outer periphery of said ink drum; and cutting means for cutting off the master;

said control means controlling said cutting means such that the master is cut off at a length corresponding to the size of the paper, and controlling an operation of said contact area varying means in accordance with the length of said master.

28. A stencil printer as claimed in claim 19, wherein said paper discharging section comprises:

a plurality of bins supported in a framework one above the other;

distributing means for distributing the paper to a designated one of said plurality of bins;

conveying means for selectively forming, in accordance with a support position of a path selector, a sort path for guiding the paper to said distributing means and a non-sort path for guiding said paper to said paper discharge tray; and switching drive means for switching the support position of said path selector in such a manner as to form either one of said sort path and said non-sort path;

said control means controlling an operation of said distributing means and controlling an operation of said switching drive means such that said path selector is selectively located at a support position for forming said sort path or a support position for forming said non-sort path.

29. A stencil printer as claimed in claim 19, further comprising an ADF (Automatic Document Feeder) including a document feed tray to be loaded with the document and feeding means for feeding said document from said document feed tray to a document reading section.

* * * * *

UNITED STATES PATENT AND TRADEMARK OFFICE

CERTIFICATE OF CORRECTION

PATENT NO. : 6,305,281 B1
DATED : October 23, 2001
INVENTOR(S) : Hidetoshi Aizawa It is certified that error appears in the above-identified patent and that said Letters Patent is hereby corrected as shown below:

Column 1,
Line 25, delete "irk" and insert -- ink --;
Line 26, delete "damper" and insert -- clamper --;
Line 42, delete "mater" and insert -- master -- and
Line 44, delete "consumpt ion" and insert -- consumption --.

Column 2,
Line 48, delete "amaster" and insert -- a master --; and
Line 64, between "orientation" and "the document" insert -- of --.

Column 4,
Line 4, delete "Between" and insert -- between --;
Lines 54 and 61, delete "camper" and insert -- clamper --.

Column 5,
Line 21, delete "camper" and insert -- clamper --.

Column 6,
Line 43, delete "camper" and insert -- clamper --; and
Line 45, delete "damper" and insert -- clamper --.

Column 7,
Line 56, delete "am" and insert -- arm --; and
Line 66, take the space out of "journal led".

Column 8,
Line 13, take the space out of "control led".

Column 9,
Line 15, take the space out of "journal led".
Line 23, take the space out of "photo inter-"; and
Line 47, take the space out of "photo interrupter".

Column 10,
Line 9, delete "1204" and insert -- 104 --.

Column 11,
Line 39, delete "aclesired" and insert -- a desired --.

Column 12,
Line 32, delete "paper" and insert -- papers --.

UNITED STATES PATENT AND TRADEMARK OFFICE

CERTIFICATE OF CORRECTION

PATENT NO. : 6,305,281 B1
DATED : October 23, 2001
INVENTOR(S) : Hidetoshi Aizawa It is certified that error appears in the above-identified patent and that said Letters Patent is hereby corrected as shown below:

Column 13,
Line 4, delete "oF" and insert -- of --; and
Line 66, delete "a" and insert -- α--.

Column 14,
Line 6, delete "damper" and insert -- clamper --.

Column 15,
Line 62, delete "2," and insert -- 21 --.

Column 16,
Line 58, delete "disirably" and insert -- desirably --.

Column 19,
Line 50, delete "itcgular" and insert -- irregular --.

Column 20,
Line 23, insert a space between "means" and "100"; and
Line 63, delete "; enlarged" and insert -- enlarged.

Column 21,
Line 14, delete "30" and insert -- 60 --.

Column 23,
Lines 43-44, delete "journal led" and insert -- journalled --;
Line 58, delete "b in" and insert -- bin --; and
Line 65, delete "distributes" and insert -- distributed --.

Column 24,
Line 42, delete "suck" and insert -- sucks --.

Column 26,
Lines 10-11, delete "bas is" and insert -- ba-sis --;
Line 16, delete "sores" and insert -- stores --;
Line 26, delete "selector" and insert -- selection --; and
Line 52, delete "mater" and insert -- master --.

Column 28,
Line 62, delete "control led" and insert -- controlled --.

UNITED STATES PATENT AND TRADEMARK OFFICE

CERTIFICATE OF CORRECTION

PATENT NO. : 6,305,281 B1
DATED : October 23, 2001
INVENTOR(S) : Hidetoshi Aizawa It is certified that error appears in the above-identified patent and that said Letters Patent is hereby corrected as shown below:

Column 33,
Line 11, delete "for ward" and insert -- forward --.

Signed and Sealed this

Thirtieth Day of April, 2002

*Attest:*

*Attesting Officer*

JAMES E. ROGAN
*Director of the United States Patent and Trademark Office*